US006370769B1

(12) United States Patent
Lilienthal, II

(10) Patent No.: US 6,370,769 B1
(45) Date of Patent: Apr. 16, 2002

(54) AUTOMATED ASSEMBLY OF CONNECTOR TO CABLE HAVING TWISTED WIRE PAIRS

(75) Inventor: Peter F. Lilienthal, II, Princeton, NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/427,915

(22) Filed: Oct. 27, 1999

(51) Int. Cl.[7] ..... H01R 43/04

(52) U.S. Cl. ..... 29/861; 29/863; 29/866; 29/748; 29/749

(58) Field of Search ..... 29/857, 861, 863, 29/866, 748, 749, 33 F, 33 M, 755; 209/580; 156/380.6, 530

(56) References Cited

U.S. PATENT DOCUMENTS

| | | | | | |
|---|---|---|---|---|---|
| 2,657,718 | A | * | 11/1953 | Greathouse | 140/93 R |
| 2,764,237 | A | * | 9/1956 | Adams et al. | 26/33 F |
| 3,779,290 | A | * | 12/1973 | Rich et al. | 140/1 |
| 3,891,013 | A | * | 6/1975 | Folk et al. | 29/749 X |
| 4,132,251 | A | * | 1/1979 | Folk et al. | 140/147 |
| 4,219,913 | A | * | 9/1980 | Johnson, Jr. | 29/33 M |
| 4,379,609 | A | | 4/1983 | Hardesty | |
| 4,441,778 | A | | 4/1984 | Sampson | |
| 4,516,309 | A | | 5/1985 | Clark | |
| 4,731,663 | A | * | 3/1988 | Kovalchick et al. | 382/165 |
| 5,162,792 | A | * | 11/1992 | Morris | 340/2.1 |
| 5,601,447 | A | | 2/1997 | Reed et al. | |
| 5,655,284 | A | | 8/1997 | Ferrill et al. | |
| 5,659,948 | A | * | 8/1997 | Vanderhoof et al. | 29/749 |
| 5,961,354 | A | * | 10/1999 | Hashim | 439/676 |
| 5,987,743 | A | * | 11/1999 | Yui | 29/850 |
| 5,996,224 | A | * | 12/1999 | Sullivan | 29/863 |
| 6,158,113 | A | * | 12/2000 | Saito et al. | 29/33 F |

OTHER PUBLICATIONS

Brachman, Ribbon Cable for Reliable Interconnections Jul. 7, 1986, Electronic Packaging and Production vol. 26, pp. 58–59.*

Internet pages on "Network Cabling Standard", from www.siemon.com, 10 pages dated Apr. 19, 1999, 5 pages dated Apr. 23, 1999.

Internet pages on "110 Color Coded Designation Strips and 110 Patch Cords" from www.ortronics.com, 2 pages dated Apr. 23, 1999.

Power Sum Quick Port (R) Snap–It Connectors Part 41108–xxS, Leviton Telecom, pp. 1 and 2, date 1/99.

Internet pages on "Systimax Gigaspeed Structured Connectivity Solution", from www.Lucent .com, 11 pages dated Feb. 10, 1999.

TIA/EIA Telecommunications Network, Tranmission Performance Specifications for Field Testing of Unshielded Twisted–Pair Cabling Systems, TSB 67, pp. 1–33, Oct. 1995.

L–Com, Data, Video, Voice and RF Connectivity Products, Supplement Catalog 2.0 1998.

L–Com, Data, Video, Voice and RF Connectivity Products, Connectivity Supplement 1999.

* cited by examiner

*Primary Examiner*—Stephen K. Cronin
*Assistant Examiner*—Joseph C. Merek

(57) ABSTRACT

A cable having at least two twisted wire pairs, each of the wires in the twisted wire pairs having wire jacket with a respectively different color, is automatically assembled by automatically detecting the colors of the wire jackets and automatically positioning the wires of the twisted wire pairs in a predetermined sequence based on the colors of the wire jackets. A machine vision system is used for detecting the colors of the wire jackets. A connector is then automatically attached to the automatically positioned wires. The connector may be a 110 connector, a D8GS connector, an RJ45 connector or an RJ11 connector.

16 Claims, 28 Drawing Sheets

FIG. 24
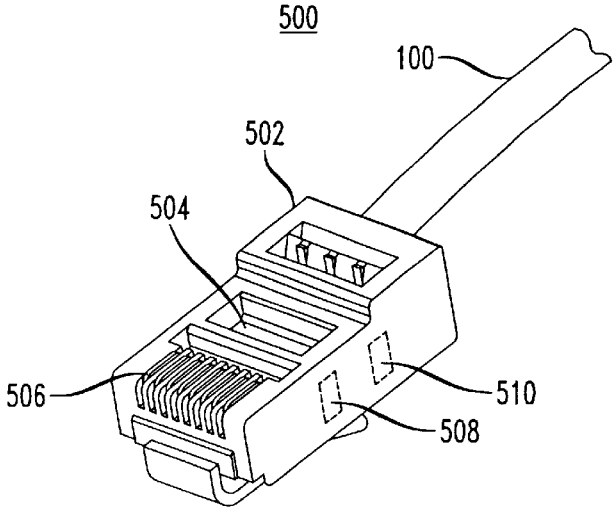
FIG. 25A
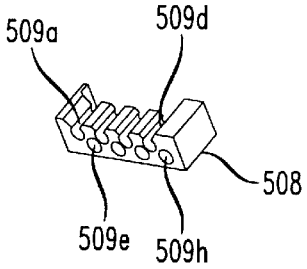
FIG. 25B
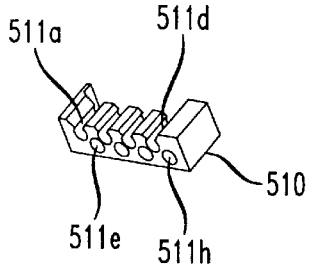
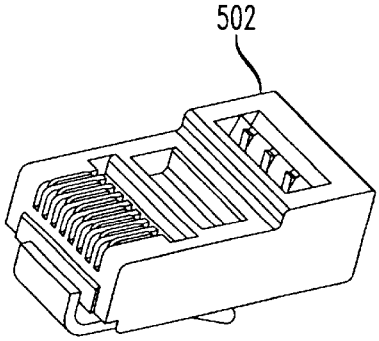
FIG. 26A
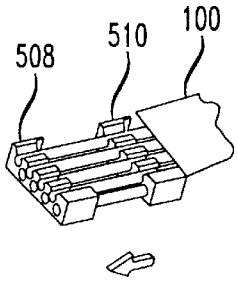
FIG. 26B

600

AUTOMATED ASSEMBLY OF CONNECTOR TO CABLE HAVING TWISTED WIRE PAIRS

BACKGROUND OF THE INVENTION

The present invention relates to the manufacturing of electrical cables and, more particularly, the automated assembly of electrical cables having at least one twisted pair of wires.

As used herein and in the claims, a "cable" is a length of insulated wire or wires, also referred to as conductors, terminated on at least one of its ends with an interface, also referred to as a termination, having a housing which allows access to the wire. Usually, a cable has terminations on both of its ends, but such terminations need not be of the same type. A cable is also referred to as a cord.

Electrical signal transmission cables for connecting pieces of equipment are of two forms: cables in flat flexible form having conductors always in the same position, or cables with twisted pair conductors.

A cable with unshielded twisted pairs (UTP) is terminated with a connector such as a 110 connector, a D8GS connector, an RJ45 connector or an RJ11 connector. RJ45 connectors and RJ11 connectors are sometimes used with modular cords. Selection of the type of connector for a cable is based on the performance levels needed for the intended use.

FIGS. 4 and 8 show two piece type 110 connector 200 and four piece type 110 connector 300, respectively. 110 connectors are used for patching between communication blocks for data and voice.

FIG. 20 shows D8GS connector 400. D8GS connectors are used for high speed data transmission.

FIG. 24 shows RJ45 connector 500. RJ45 connectors are used to connect voice and data communication equipment with RJ45 ports. An RJ11 connector is similar to an RJ45 connector except that the RJ11 connector is used with a single twisted pair while the RJ45 connector is used with four twisted pairs.

The size and shape of the housing of a D8GS, RJ45 and RJ11 connector is different than that of the housing of a 110 connector, and accordingly, the ordering of wires is different when assembled.

Each of the connectors in FIGS. 4, 8, 20 and 24 may be used with cable 100.

For clarity in the drawings, only reference numerals for the first and last of comparable elements are sometimes shown.

FIG. 1 shows cable 100 having four twisted wire pairs. Cable 100 includes jacket 111 and wires 120, 130, 140, 150, 160, 170, 180, 190 formed into a first twisted wire pair including wires 120 and 130, a second twisted wire pair including wires 140 and 150, a third twisted wire pair including wires 160 and 170, and a fourth twisted wire pair including wires 180 and 190. Each pair is twisted to reduce the cross-talk between the wires in the pair. The twist rate is different on each pair to further reduce cross-talk between pairs. The length of cable 100 ranges from a few feet to about 33 feet.

Jacket 111 is circular in cross section and is typically formed of flame retardant PVC or another plastic or insulative material. Jacket 111 functions as an outer cover to insulate the twisted wire pairs inside.

Insulating wire jackets 122, 132, 142, 152, 162, 172, 182, 192 are jackets for conductors 124, 134, 144, 154, 164, 174, 184, 194, respectively, and have respectively different colors for identification. Usually, jacket 122 is dark brown, jacket 132 is light brown, jacket 142 is dark blue, jacket 152 is light blue, jacket 162 is dark green, jacket 172 is light green, jacket 182 is orange and jacket 192 is white.

FIG. 2 shows an enlarged view of wire 120 in FIG. 1. Wires 125*a*–125*g* are combined together, typically having one central wire and the remaining wires wrapped around the central wire, and covered by insulating jacket 122 to form multi-conductor wire 120. The number of conductors inside a wire varies depending on the gauge. Generally, a plurality of thin conductors provides better conductivity with larger surface area than a single conductor, which improves transmission quality for high frequency signals. Also multi-conductor wires bend more easily and absorb mechanical load better than single conductor wires. Wires 130, 140, 150, 160, 170, 180, 190 have a similar structure to wire 120.

FIG. 3 shows cable 10 having two pairs of twisted wires. Cable 10 includes jacket 12 and wires 20, 30, 40, 50 formed into a first twisted wire pair including wires 20 and 30, and a second twisted wire pair including wires 40 and 50. Cable 10 is similar to cable 100 in FIG. 1 except for its number of twisted wire pairs.

FIG. 4 shows assembled two piece type 110 connector 200 which comprises first housing member 202, second housing member 204 and cable 100. Cable 100 and first housing member 202 are assembled first, then second housing member 204 is joined to first housing member 202 to form two piece type 110 connector 200. Members 202, 204 are shown in details in FIGS. 5 and 6, respectively.

FIG. 5 illustrates first housing member 202 of two piece type 110 connector 200. First housing member 202 has support members 206, 208, 210. Members 206 and 208 receive cable 100. Member 210 functions as a cable jacket stop when cable 100 is mounted on members 206, 208. Upstanding posts 216*a*–216*g* define gaps 220*a*–220*h* for each of wires 120, 130, 140, 150, 160, 170, 180, 190 of cable 100. Insulation displacement contact (IDC) grooves 217*a*–217*h* receive IDCs 246*a*–246*h* of second housing member 204 of FIG. 6. Posts 218*a*–218*g* meet and separate each of IDCs 246*a*–246*h* of contacts 242*a*–242*h* of second housing member 204 of FIG. 6, so that it is easier for IDCs 246*a*–246*h* to cut insulation 122, 132, 142, 152, 162, 172, 182, 192 of wires 120, 130, 140, 150, 160, 170, 180, 190 of cable 100 when second housing member 204 is mated to first housing member 202. Latching arms 224*a*–224*c* and press fit members 212*a*–212*b* engage with corresponding shoulders and latching arms in second housing member 204 when the two housing members are mated. Openings 214*a*–214*b* around press fit members 212*a*–212*b* serve as complementary recesses to receive corresponding latching arms of second housing member 204. Gap spacers 222*a*–222*d* are located next to latching arms 224*a*–224*c* to maintain a space between first and second housing members 202, 204 when they are assembled.

FIG. 6 illustrates second housing member 204 of two piece type 110 connector 200. Second housing member 204 has cable receiving end 230 and upstanding projection 232. Projection 232 functions as a strain relief to overlying cable 100 when cable 100 is mounted thereon. Upstanding posts 238*a*–238*h* are provided to press wires 120, 130, 140, 150, 160, 170, 180, 190 of cable 100 when two housing members 202, 204 are assembled together. Latching arms 234*a*–234*d* are provided for engaging with press fit members 212*a*–212*b* of first housing member 202. Between latching arms 234*a*–234*d*, openings 236*a*–236*b* are respectively provided to receive press fit members 212*a*–212*b* of first housing member 202. Openings 248*a*–248*c* are provided as respective shoulders for latching arms 224*a*–224*c* of first housing member 202. Slots 240*a*–240*h* are provided to receive the blades of contacts 242*a*–242*h*. IDCs 246*a*–246*h* are located at the end of contacts 242*a*–242*h* and cut insulation 122, 132, 142, 152, 162, 172, 182, 192 of wires 120, 130, 140, 150, 160, 170, 180, 190 of cable 100, respectively, when assembled with first housing member 202.

A conventional assembling sequence of first housing member 202 with cable 100 will now be described.

An assembly worker prepares cable 100 by removing jacket 111 from an end of cable 100 to expose pairs 120–130, 140–150, 160–170, 180–190 of wires of cable 100. The assembly person appropriately relocates the pairs depending on the colors of the jackets, and positions cable 100 in first housing member 202. Jacket 111 of cable 100 seats in slots 206, 208 and ends just before slot 210. Starting from slot 210, the worker routes each of wires 120, 130, 140, 150, 160, 170, 180, 190 of cable 100 and respectively inserts them into gaps 220*a*–220*h*. After appropriate positioning, the assembly worker trims the ends of the wires using a suitable flush cutting tool to ensure that the remaining wire ends are uniformly positioned between upstanding posts 216*a*–216*h* and posts 218*a*–218*g* of first housing member 202. Next, the worker aligns and presses members 202 and 204 together, thereby inserting IDCs 246*a*–246*h* of contacts 242*a*–242*g* of second housing member 204. IDCs 246*a*–246*h* pierce insulation 122, 132, 142, 152, 162, 172, 182, 192 of wires 120, 130, 140, 150, 160, 170, 180, 190 of cable 100 when assembled with first housing member 202. The worker tries to maintain the twist rates between the twisted wire pairs, shown in FIG. 1, throughout the assembly process.

FIG. 7 shows first housing member 202 assembled with cable 100 according to the assembly method described above. As indicated in FIG. 7, the original twist rates on each of the twisted wire pairs 120–130, 140–150, 160–170, 180–190 is maintained as much as possible by the assembly worker during manual assembly. The end of wires 120, 130, 140, 150, 160, 170, 180, 190 are positioned and trimmed right after posts 218*a*–218*g* where IDCs 246*a*–246*h* of second housing member 204 cut insulation 122, 132, 142, 152, 162, 172, 182, 192 of wires 120, 130, 140, 150, 160, 170, 180, 190 of cable 100.

FIGS. 8A–8F show the components of four piece type 110 connector 300 before assembly. Four piece type 110 connector 300 is designed to terminate a cable having four twisted pairs and to mate with a 110-type connecting block. Four piece type 110 connector 300 comprises base member 302, contact base 308, contact 309 (only the four top contacts are shown), first housing member 304 and second housing member 306. Base member 302 mounts cable 100 and is fitted between first housing member 304 and second housing member 306. Base member 302 has channels 317*a*–317*h* for receiving wires 120, 130, 140, 150, 160, 170, 180, 190 of cable 100. Channels 317*a*–317*h* of base member 302 provide routing paths for individual wires 120, 130, 140, 150, 160, 170, 180, 190, respectively. Base member 302 is also provided with IDC grooves 318*a*–318*h* to receive the IDCs of contact 309. Contact base 308 is assembled with contact 309, and then inserted into base member 302 in which cable 100 is mounted. First housing member 304, second housing member 306, contact base 308 and base member 302 are usually made from a non-conducting injection-molded plastic, such as polycarbonate, ABS, or PVC, while contacts 309 are made from a conducting material, such as stamped phosphor bronze plated with nickel and gold. Four piece type 110 connector 300 is designed to reduce the variation of cross talk throughout assembled connectors caused by lack of the control of routing of wires 120, 130, 140, 150, 160, 170, 180, 190 of cable 100 during an assembly process. Members 302, 304, 306, 308 are shown in detail in FIGS. 9, 10, 11 and 12, respectively.

FIG. 9 illustrates base member 302 of four piece type 110 connector 300. Base member 302 has slot 310 to receive cable 100. Slot 312 functions as a cable jacket stop when cable 100 is mounted in slot 310. Openings 314*a*, 314*b* form a through-space for latching arms and press fit members of first and second housing members 304, 306 when they are mated. Channels 317*a*–317*h* define routing paths for wires 120, 130, 140, 150, 160, 170, 180, 190 of cable 100. Upstanding posts 316*a*–316*g* are located along front edge 320 of base member 302 to define IDC grooves 318*a*–318*h*.

FIG. 10 illustrates contact 309 placed on the top side of contact base 308. Contact base 308 also receives four bottom contacts (not shown) on its bottom side. The designs of the top and bottom contacts are identical. As configured for assembly, contact 309 is rotated 180 degrees about its longitudinal axis with respect to the bottom contact. IDCs 322*a*–322*d* of contact 309 and the corresponding IDCs of the bottom contact (not shown) cut and terminate insulation 122, 132, 142, 152, 162, 172, 182, 192 of wires 120, 130, 140, 150, 160, 170, 180, 190 of cable 100. Grooves 328*a*–328*d* receive blades 324*a*–324*d* of contact 309. Openings 326*a*326*d* are provided for latching arms 338*a*–338*d* of first housing member 304, shown in FIG. 11.

FIG. 11 illustrates first housing member 304 of four piece type 110 connector 300. After base member 302 is assembled with contact base 308, first housing member 304 is attached to the bottom of the assembled members 302 and 308. First housing member 304 also opposes second housing member 306. Slot 330 is a receiving space for cable 100. Press fit members 332*a*–332*b* fit with latching arms 354*a*–354*d* of second housing member 306. Openings 334*a*–334*b*, 336*a*–336*d* serve as complementary recesses and shoulders for latching arms 354*a*–354*b*, 354*c*–354*d*, 358*a*–358*d*, respectively, of second housing member 306. Grooves 340*a*–340*h* fit with the vertically positioned blades of contacts 324*a*–324*h* of contact member 308. Upstanding protrusions 338*a*–338*d* press against the surface of the blades of contacts 324*a*–324*h* of contact member 308.

FIG. 12 illustrates second housing member 306 of four piece type 110 connector 300. Second housing member 306 is attached to the top of base member 302 after base member 302 is assembled with contact member 308 and first housing member 304. Cable receiving end 350 and upstanding projection 352 receive cable 100. Upstanding projection 352 functions as a strain relief to overlying cable 100. Latching arms 354*a*–354*d* and 358*a*–358*d* are provided for engaging with corresponding press fit members 332*a*–332*b* and openings 336*a*–336*d* of first housing member 304, respectively. Openings 356*a*–356*b* are provided to receive press fit members 332*a*–332*b* of first housing member 304. Grooves 364*a*–364*h* are provided to fit with one side of the vertically positioned blades 324*a*–324*h* of contacts 309. Upstanding protrusions 362*a*–362*d* are provided to press against the surface of blades 324*a*–324*h* of contact 309.

Assembly of four piece type 110 connector 300 with cable 100 is now described.

FIG. 13 is a view of base member 302 assembled with cable 100. An assembly worker prepares cable 100 by removing jacket 111 from an end of cable 100 to expose twisted pairs 120–130, 140–150, 160–170, 180–190 of cable 100. Jacket 111 of cable 100 is placed on slot 310 of base member 302 and ends at slot 312 of base member 302. Starting from slot 312 of base member 302, the worker routes each of wires 120, 130, 140, 150, 160, 170, 180, 190 of cable 100 and inserts them into the appropriate one of channels 317*a*–317*h* of base member 302. The assembly worker appropriately relocates the pairs depending on the colors of the jackets, and positions cable 100 in base member 302. The assembly worker tries to maintain the twist rates between twisted pairs 120–130, 140–150, 160–170, 180–190 of cable 100 throughout the assembly process.

FIG. 14 is a view of the sub-assembly of FIG. 13 after wires 120, 130, 140, 150, 160, 170, 180, 190 of cable 100 have been positioned within IDC grooves 318*a*–318*h* of base member 302. The assembly worker guides wires 120, 130, 140, 150, 160, 170, 180, 190 through channels 317*a*–317*h* and bends the wires at front edge 320 of base member 302. Pyramidal structures at the top of upstanding posts 316*a*, 316*c*, 316*e*, 316*g* assist in the separation of individual wires 120, 130, 140, 150, 160, 170, 180, 190 from twisted pairs 120–130, 140–150, 160–170, 180–190 of cable 100 as the twisted pairs are inserted into IDC grooves 318*a*–318*h*.

After appropriate positioning, the assembly worker trims the ends of wires 120, 130, 140, 150, 160, 170, 180, 190 using a suitable flush cutting tool. FIG. 15 is a view of the sub-assembly of FIG. 14 after wires 120, 130, 140, 150, 160, 170, 180, 190 of cable 100 have been trimmed to terminate at the bottom of base member 302.

FIGS. 16A and 16B illustrate how contact base 308 loaded with contact 309 (not shown in FIG. 16A, see FIG. 10) is mated to base member 302 loaded with cable 100. After base member 302 is assembled with cable 100 and contact base 308 is assembled with contact 309, the assembly worker mates the assembly of contact 309 and contact base 308 to the assembly of base member 302 and cable 100. IDCs 322*a*–322*h* of contact 309 are received within IDC grooves 318*a*–318*h* of base member 302 at right angle to wires 120, 130, 140, 150, 160, 170, 180, 190, cutting insulating jackets 122, 132, 142, 152, 162, 172, 182, 192 of wires 120, 130, 140, 150, 160, 170, 180, 190, respectively.

FIGS. 17 and 18 illustrate how first housing member 304 and second housing member 306 are assembled onto the sub-assembly of FIG. 16. First housing member 304 and second housing member 306 are attached to the bottom and top of the sub-assembly of FIG. 16, respectively.

FIG. 19 is a view of the completed assembly of four piece type 110 connector 300. The worker needs to align and mate the latching arms, press fit members and openings of the connector housings repeatedly by hand. Alternatively, a manually operated press may be employed.

FIG. 20 shows a view of assembled D8GS connector 400. D8GS connector 400 comprises first housing member 402 and second housing member 404, and is used with cable 100. Members 402, 404 are shown in detail in FIGS. 21 and 22, respectively.

FIG. 21 is a detailed view of first housing member 402 of D8GS connector 400. Cord input aperture 410 receives and guides cable 100 and strain relief 412 receives and presses cable 100 when an assembly worker inserts cable 100 into first housing member 402 for assembly. Shoulder 414 is provided to block jacket 111 when cable 100 is inserted into first housing member 402. Gaps 419*a*–419*h* are provided to fix the wire ends when cable 100 is inserted into first housing member 402. Latching arms 416*a*,416*b* mate with openings 424*a*–424*b* of second housing member 404 as shown in FIG. 22. Lever 418 of FIG. 21 is provided to push lever 426 of second housing member 404 of FIG. 22 when D8GS connector 400 is unplugged from communication equipment (not shown).

FIG. 22 illustrates second housing member 404 of D8GS connector 400. Second housing member 404 is provided with cavity 420 to receive first housing member 402 which is assembled with cable 100. IDCs 422*a*–422*h* are provided to receive and cut insulation 122, 132, 142, 152, 162, 172, 182, 192 of wires 120, 130, 140, 150, 160, 170, 180, 190 of cable 100, respectively. Openings 424*a*–424*b* are provided to receive latching arms 416*a*–416*b* of first housing member 402.

FIG. 23 is a view of first housing member 402 assembled with cable 100. An assembly worker removes jacket 111 of cable 100 from an end of cable 100 to expose the pairs of wires 120–130, 140–150, 160–170, 180–190 of cable 100. The worker inserts the exposed end portion of wires 120, 130, 140, 150, 160, 170, 180, 190 of cable 100 through cord input aperture 410 of first housing member 402 until the leading end of jacket 111 abuts shoulder 414 formed internally in first housing member 402.

The worker then places the twisted pairs in grooves 419*a*–419*h*, respectively, of first housing member 402. The worker then trims the wire ends. The wire placement and trimming follows a generally similar sequence as shown in FIGS. 13–15. The worker then mates second housing member 404 to first housing member 402, as assembled with cable 100, by manually aligning IDCs 422*a*–422*h* of second housing member 404 with wire ends fixed at gaps 419*a*–419*h* of first housing member 402.

FIG. 24 shows a view of RJ45 connector 500, assembled with cable 100. RJ45 connector 500 comprises plug 502, management bars 508, 510 (not shown) and contact member 506. Management bars 508, 510 are provided to align wires 120, 130, 140, 150, 160, 170, 180, 190 of cable 100 before the wires are inserted into plug 502. Plug 502 is provide with a cavity (not shown) to receive wires 120, 130, 140, 150, 160, 170, 180, 190 of cable 100. Strain relief 504 of plug 502 is provided to release tension exerted upon overlying cable 100. Metal contact 506 conducts signal from wires 120, 130, 140, 150, 160, 170, 180, 190 of cable 100 to the communication equipment (not shown) when RJ45 connector 500 is mated to the plug of the communication equipment.

FIGS. 25A, 25B illustrate management bars 508, 510, respectively. Management bar 508 has grooves 509*a*–509*d* and holes 509*c*–509*h*. Management bar 510 has a similar structure to management bar 508. Each of the holes and grooves of management bars 508, 510 is used with a predefined colored wire jacket of cable 100.

The assembly process of RJ45 connector 500 is now described.

An assembly worker prepares cable 100 by removing jacket 111 from an end of cable 100 to expose the wire pairs 120–130, 140–150, 160–170, 180–190 of cable 100. The assembly worker orients cable 100 and sets wire pairs 120–130, 140–150, 160–170, 180–190 into a predetermined sequence depending on the color of insulating jackets 122, 132, 142, 152, 162, 172, 182, 192. The worker uses appropriate tools to spread jacket 111 of cable 100 so that wire pairs 120–130, 140–150, 160–170, 180–190 lay beside each other. The worker then untwists each of wire pairs 120–130, 140–150, 160–170, 180–190 and arranges the untwisted wires 120, 130, 140, 150, 160, 170, 180, 190 into two rows for ease of wire insertion into grooves 509*a*–509*d* and holes 509*e*–509*h* of management bar 508 and corresponding grooves and holes of management bar 510. The assembly worker inserts the arranged wires 120, 130, 140, 150, 160, 170, 180, 190 into the grooves and holes of the management bars 508, 510 according to a predetermined sequence. The assembly worker then trims any excess wire at the edge of outer management bar 510 and inserts wires 120, 130, 140, 150, 160, 170, 180, 190, as assembled with management bars 508, 510, into plug 502.

FIGS. 26A, 26B show wires 120, 130, 140, 150, 160, 170, 180, 190 of cable 100 assembled with management bars 508, 510 just before insertion into plug 502.

Due to the complex nature of the assembly process, it is typical for assembly workers to make mistakes throughout the assembly steps. The assembly workers create differences from cable to cable in untwisting twisted wire pairs, differences from cable to cable in how forcefully the wires are placed into slots of the connector housing, and errors in placing the correct color wires in slots of the connector housing. The assembly workers sometimes fail to bring the wires out to the edge of the connector housing.

While cables with flat flexible cables are known to be automatically assembled, twisted wire pair cables have always been assembled manually due to the complex nature of the assembly process discussed above. Nevertheless, automated assembly of twisted wire pair cables is desirable to reduce performance variations between cables.

SUMMARY OF THE INVENTION

In accordance with an aspect of this invention, there is provided a method of and an apparatus for automatically assembling a cable having at least two twisted wire pairs, each of the wires in the twisted wire pairs having a wire jacket with a respectively different color. The colors of the wire jackets are automatically detected and the twisted wire pairs are automatically positioned in a predetermined sequence based on the colors of the wire jackets.

A machine vision system is used to detect the colors of the wire jackets. A pin is utilized to automatically sequence the twisted wire pairs. Connector housings are automatically attached to the sequenced twisted wire pairs. The connector may be a 110 connector, a D8GS connector, an RJ45 connector, an RJ11 connector or other connector designed for automatic assembly.

In accordance with another aspect of this invention, there is provided a method of and an apparatus for assembling a cable having at least two twisted wire pairs, each of the wires in the twisted wire pairs having a wire jacket with a respectively different color. The colors of the wire jackets are automatically detected and the wires of the twisted wire pairs are automatically positioned in a predetermined sequence based on the colors of the wire jackets.

It is not intended that the invention be summarized here in its entirety. Rather, further features, aspects and advantages of the invention are set forth in or are apparent from the following description and drawings.

BRIEF DESCRIPTION OF THE DRAWINGS

FIG. 24 is a view of RJ45 connector 500;

FIG. 25A is a view of first management bar 508 of RJ45 connector 500;

FIG. 25B is a view of second management bar 510 of RJ45 connector 500;

FIG. 26A is a view of plug 502 of RJ45 connector 500;

FIG. 26B is a view of cable 100 assembled with management bars 508, 510 just before insertion into plug 502;

DETAILED DESCRIPTION

A technique of automatically assembling twisted wire pair cables is advantageously applied with conventional 110 connectors, D8GS connectors, RJ45 connectors and RJ11 connectors.

Manufacturing cost has been a factor in deciding whether to develop and utilize an automated assembly system or to continue using a manual assembly system. Purchasing agents usually purchase cords based on lowest price yet expect to receive reliable performance, that is, purchasers are reluctant to pay for superior performance of some suppliers' cords. As a result, reducing manufacturing cost while maintaining high quality of cords has been an issue.

Manual assembly, however, increases electrical performance variation between cables. Electrical performance variation between cables introduces error into the signal carried on the cable, particularly at LAN rates of around 500 MHz, because the communication equipment is impedance-matched to an "ideal" cable, whereas the performance of an actual cable varies significantly from cable to cable for the reasons discussed above. Even for expensive communication systems, people often buy a cheaper cable and then blame errors introduced by the cheaper cable on the communication system.

A machine vision system that is able to deal with the complex nature of the twisted wire pair cables and be cost-effectively applied to the automation of twisted wire pair cable assembly has become available only within the last few years. In particular, the resolution of machine vision systems has been improved within last few years to a degree that such systems can now cost-effectively distinguish the colors and position of the twisted wire pairs.

Recently available machine vision systems are used to distinguish colors and relative positions of wire jackets automatically, thereby ensuring uniformity in assembly, such as the degree of untwisting of paired wires between cables, which in turn reduces performance variations between cables.

The present automated assembly technique may also be applied to flat cable connectors.

An advantage of cables produced using the present technique is improved performance uniformity, i.e., less electrical variations from cable to cable than with manually assembled cables. When an automatically assembled cable is used with equipment such as a patch panel, the equipment can be impedance matched to the cable's characteristics by the equipment manufacturer, rather than the end-user, improving overall performance results. The improved performance uniformity throughout connectors of the same kind also helps to customize communication links in private applications because users can readily change connections without degrading performance of the communication links.

Figure 27:
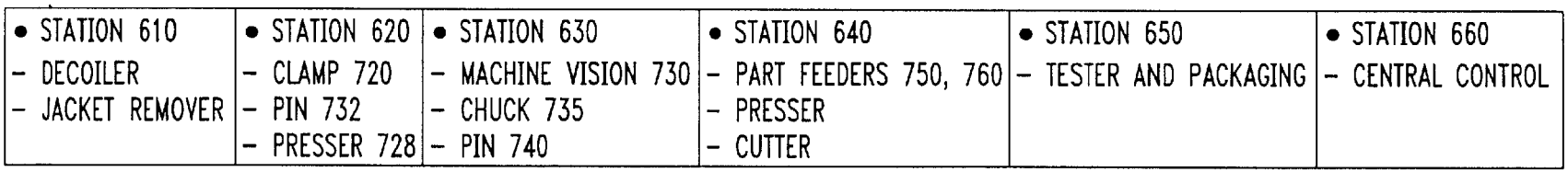
FIG. 27 is a chart of automatic assembly line 600 for two piece type 110 connector 200.

FIG. 27 is a chart representing assembly line 600 for assembling two piece type 110 connector 200. It will be appreciated that the present method can also be applied in other manufacturing configurations. One of ordinary skill will understand how to adapt the design of assembly line 600 depending on the yields and affordability of the machines used therein. Additionally, although most of the functions of assembly line 600 are shown as entirely automated, in other embodiments some of the functions may be performed manually.

Automatic assembly of two piece type connector 200 is now described.

Figure 28:
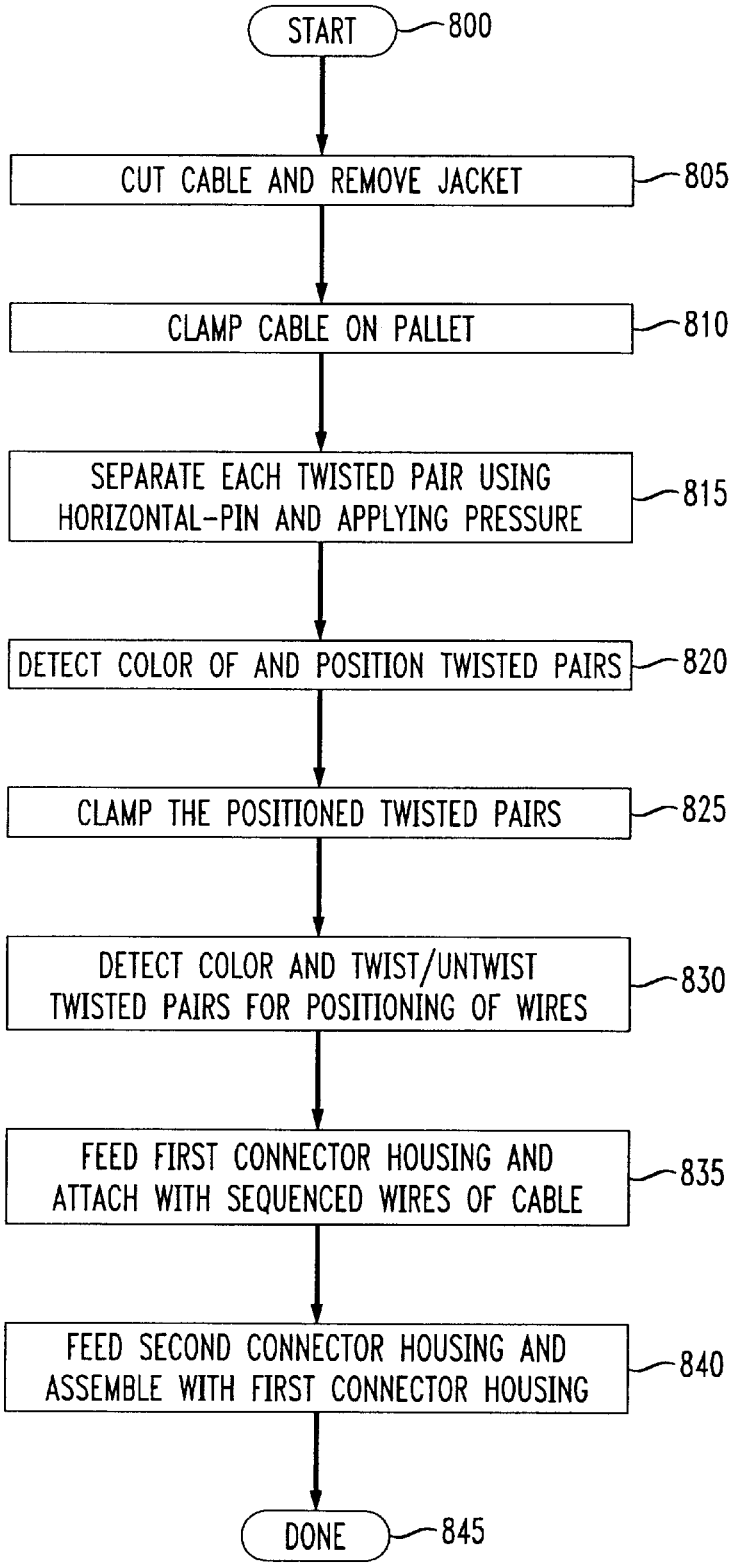
FIG. 28 is a flow chart of an automatic assembly procedure of two piece type 110 connector 200 for one embodiment.

FIG. 28 is a flow chart of an assembly procedure for one embodiment. The flow chart of FIG. 28 will be explained assuming that two piece type 110 connector 200 is being assembled.

At step 805 of FIG. 28, a predetermined length of cable 100 is uncoiled from a reel and cut. A jacket remover removes a portion of jacket 111 at each end of cable 100. The unreeling, cutting and removing are performed at station 610. Station 610 of assembly line 600 includes a decoiler (not shown) for unreeling cable 100, measuring the cable length and cutting cable 100. Station 610 also includes a jacket remover (not shown) for stripping jacket 111 of cable 100.

Figure 29A:
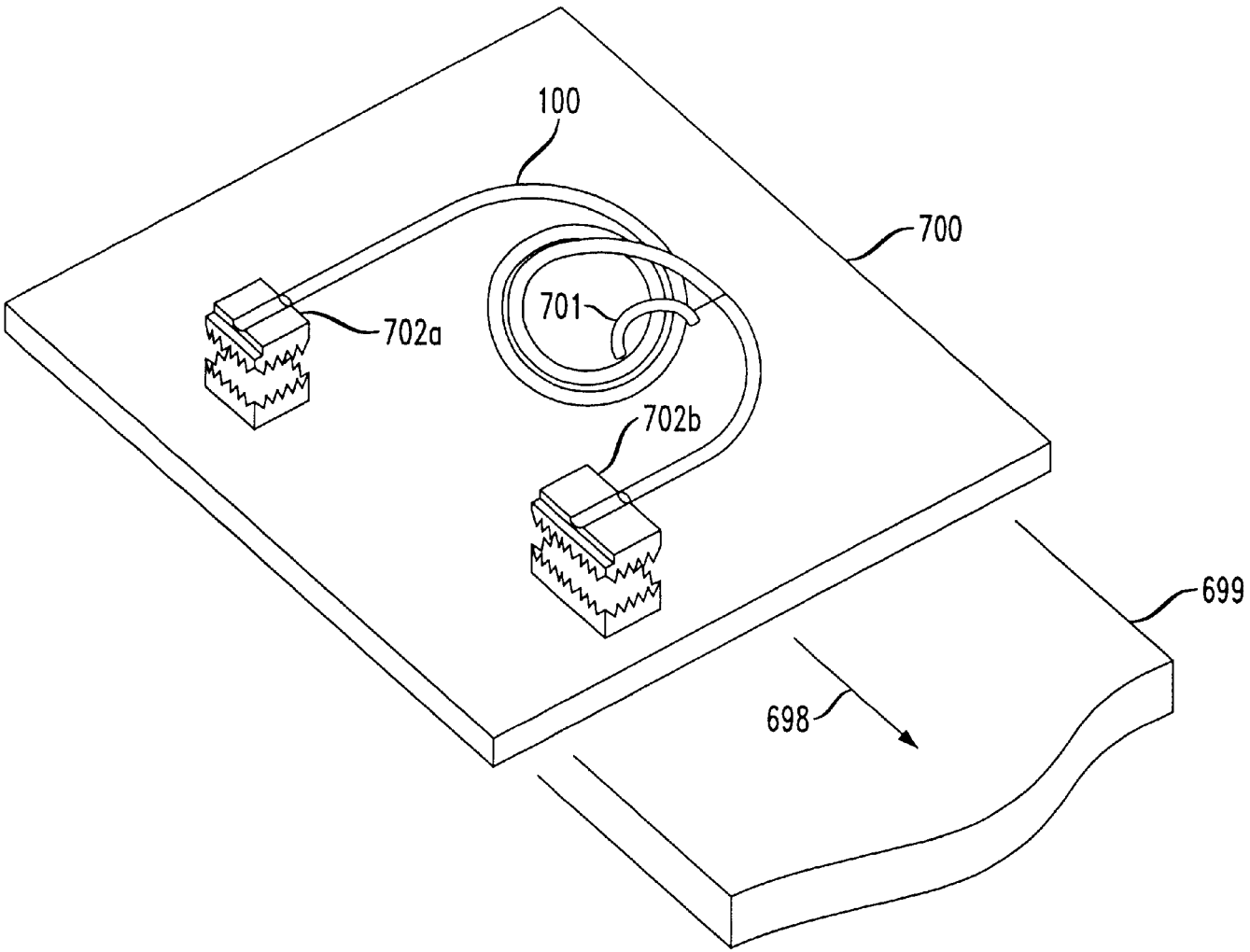
FIGS. 29A and 29B are views of pallet 700 and main body 702 of pallet 700, respectively.

FIG. 29A is a view of pallet 700. Pallet 700 is a rectangular surface loaded on assembly system conveyer 699 which serves to move pallet 700 in the direction indicated by arrow 698. After a length of cable 100 is cut, cable 100 is placed on the surface of pallet 700. U-shaped clip 701 is adapted to restrain cable 100 from falling off of pallet 700. The ends of cable 100 are placed on main bodies 702A, 702B, respectively. Main bodies 702A, 702B are identical in structure and are hereafter referred to as main body 702.

Figure 29B:
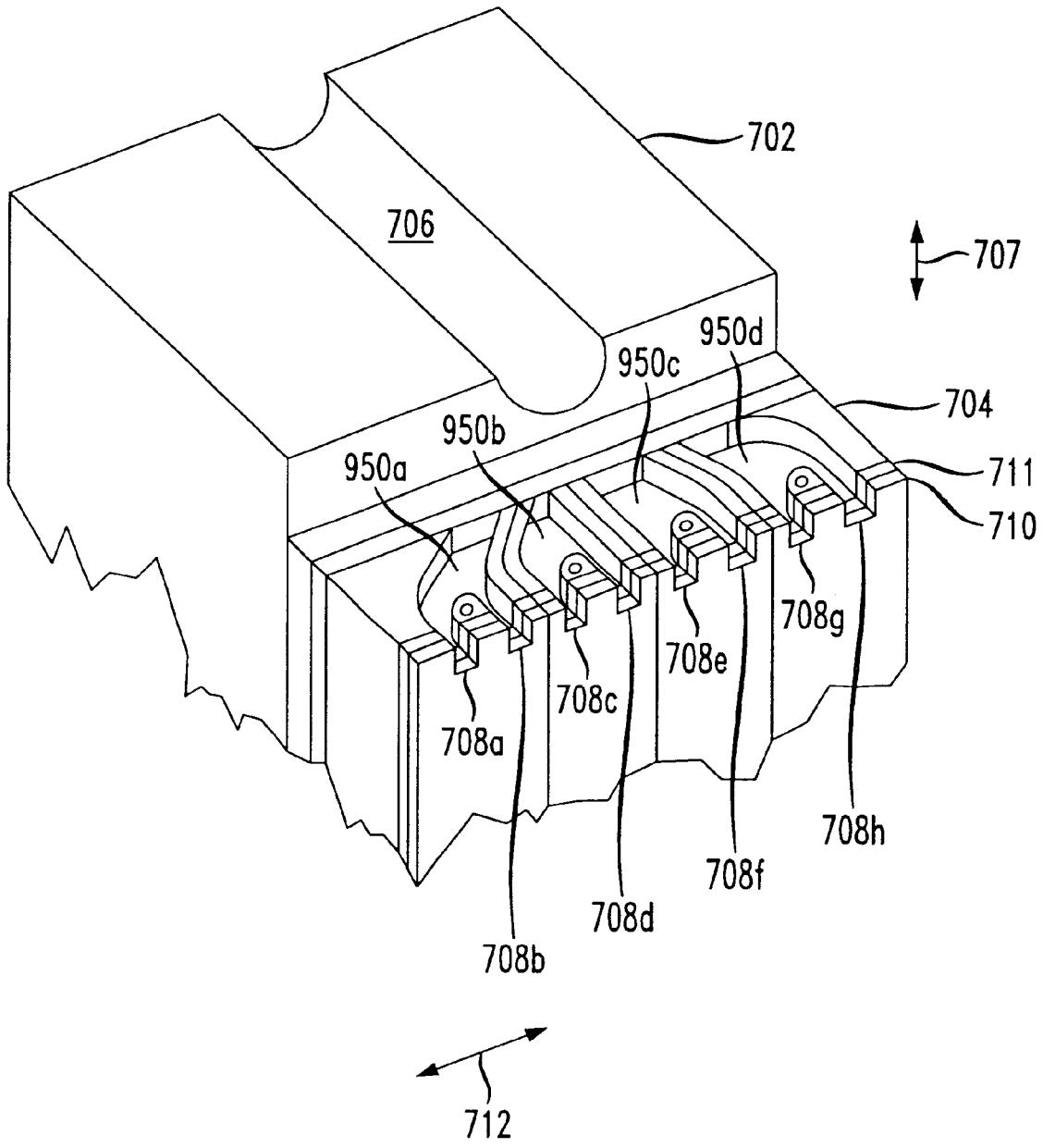

FIG. 29B illustrates main body 702 of pallet 700 on which cable 100 is mounted after the unreeling, cutting and stripping operation at step 805. Pallet 700 is moved through stations 610, 620, 630, 640, 650, 660, 670 of assembly line 600. Pallet 700 has main body 702 for mounting cable 100 and movable body 704 for manipulating the twisted wire pairs and the wires of the twisted wire pairs. Main body 702 is provided with groove 706 to mount cable 100. Movable body 704 is free to move along the direction indicated by arrow 707, thereby adjusting the height of movable body 704 and improving access to wires 120, 130, 140, 150, 160, 170, 180, 190. Grooves 950*a*–950*d* are provided to guide the twisted pairs of cable 100 after jacket 111 has been stripped from cable 100. Grooves 708*a*–708*h* are provided to guide and locate wires 120, 130, 140, 150, 160, 170, 180, 190 of cable 100 after the twisted pairs of cable 100 have been twisted or untwisted to place the twisted pairs in respective grooves 708*a*–708*h*. Movable body 704 includes movable surfaces 710, 711 which can be detached and separated from the surface of movable body 704 to inhibit the movement of the wires and to create a gap between movable body 704 and movable surfaces 710, 711. Each of movable surfaces 710, 711 moves independently along the direction indicated by arrow 712 to hold wires 120, 130, 140, 150, 160, 170, 180, 190 when they are located on grooves 780*a*–780*h* inhibiting the movement of the wires. After the unreeling, cutting and removing operation of step 805, cable 100 is placed on pallet 700.

Figure 30:
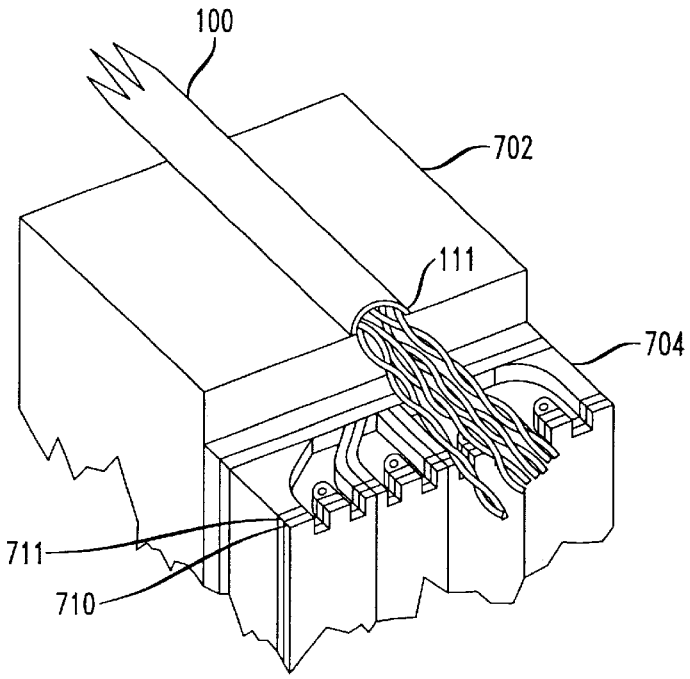
FIG. 30 is a view of stripped cable 100 mounted on pallet 700.
Figure 31:
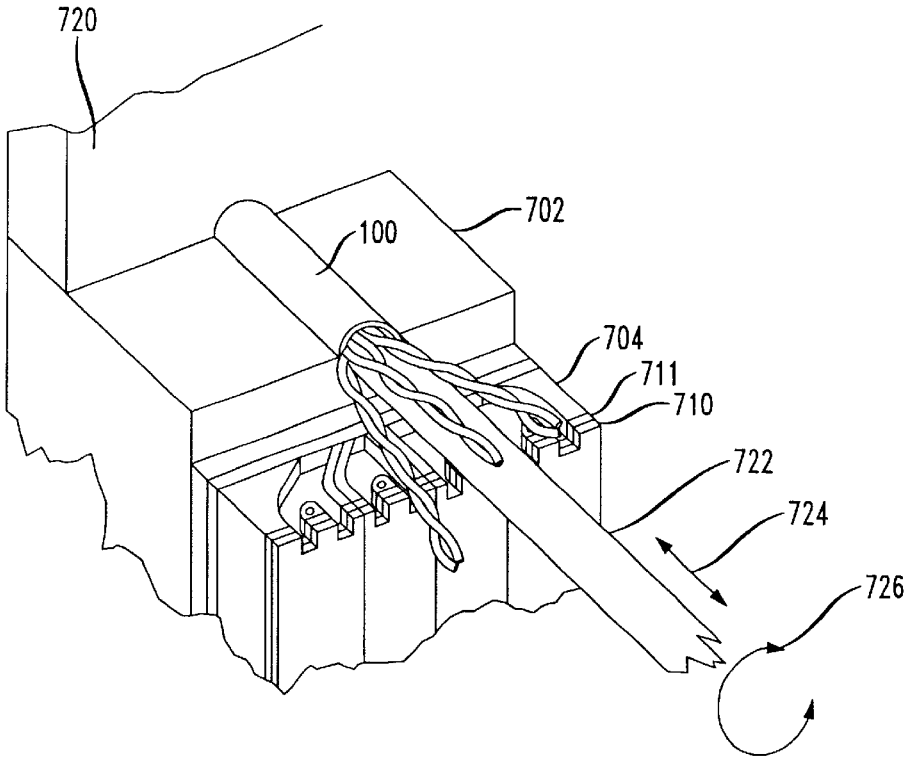
FIG. 31 is a view of clamp 720 and pin 722 working with cable 100 mounted on pallet 700.
Figure 32:
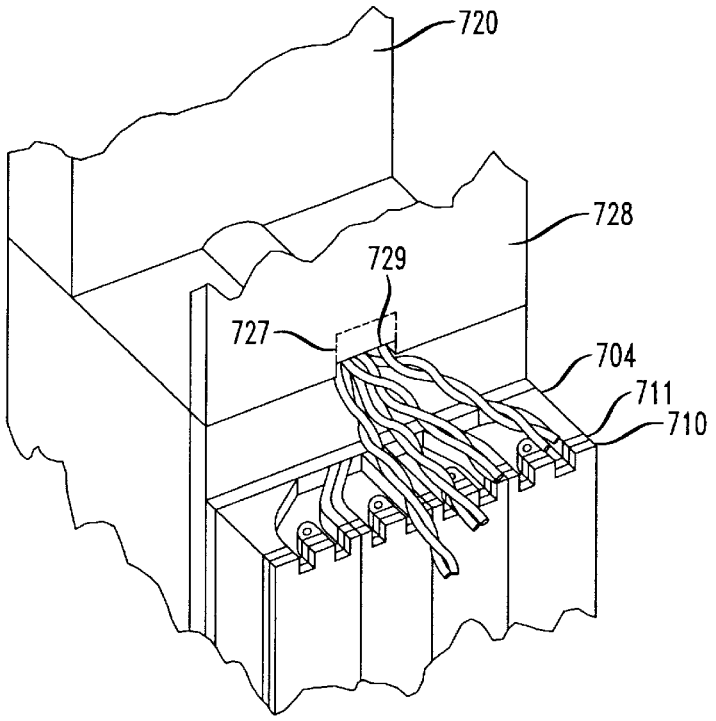
FIG. 32 is a view of presser 728 working with cable 100 mounted on pallet 700.

FIG. 30 shows stripped cable 100 mounted on pallet 700. The cut edge of jacket 111 is flush with the edge of main body 702 of pallet 700. Pallet 700 is now ready to be transferred to station 620. FIGS. 31 and 32 illustrate elements of station 620, which includes clamp 720, horizontal pin 722 and presser 728.

At step 810 of FIG. 28, cable 100 is clamped on main body 702 of pallet 700 at station 620, as shown in FIG. 31. Main body 702 is configured to hold the clamped cable so that the cable ends on main body 702 can rotate.

At step 815 of FIG. 28, horizontal pin 722 is inserted into cable 100 and applies pressure to twisted pairs 120–130, 140–150, 160–170, 180–190 of cable 100 to separate the twisted pairs against the surface of main body 702 as shown in FIG. 31.

FIG. 31 shows the clamping and pin inserting operations of steps 810 and 815. Clamp 720 is in contact with main body 702. Horizontal pin 722 can be moved along the direction indicated by arrow 724 and can be rotated along the direction indicated by arrow 726. The inserted end of pin 722 is bullet shaped, hemispherical or rounded to ensure proper fan-out. The depth of insertion of pin 722 into cable 100 must be sufficient to exceed the elastic limit of the wires, so that they retain a fanned-out configuration after pin 722 is removed.

FIG. 32 shows the pressing operation of step 815. Presser 728 presses twisted pairs 120–130, 140–150, 160–170, 180–190 of cable 100 at the edge of jacket 111 to further separate the twisted pairs. Small space 729 is provided at the bottom center of presser 728 for facilitating further movement of the twisted pairs. Space 729 is blocked by pushing down blocker 727 after the twisted pairs have been fixed, in order to inhibit further movement of the twisted pairs. Clamp 720 and presser 728 function to hold and press cable 100.

Figure 33:
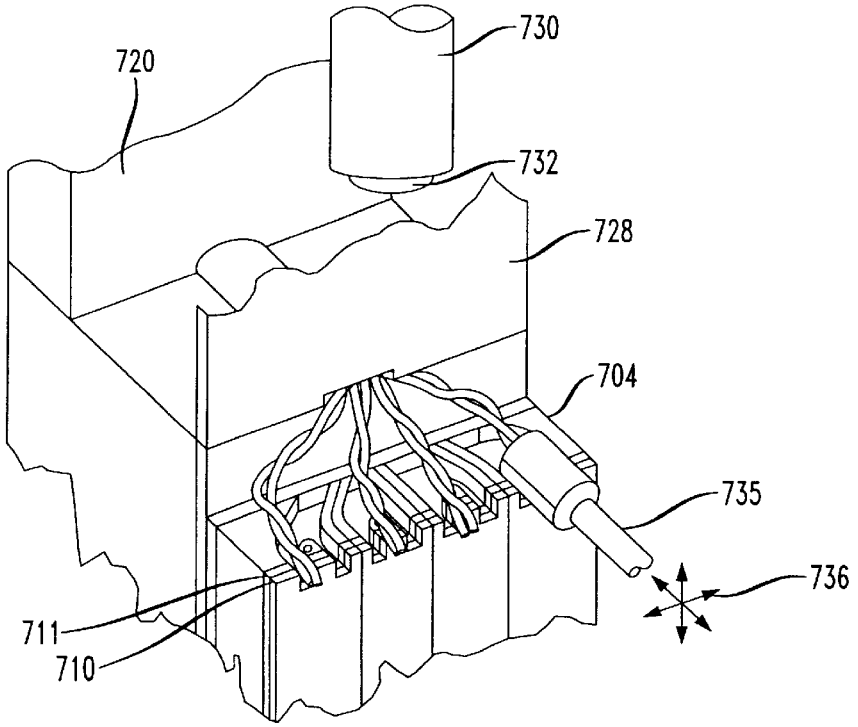
FIG. 33 is a view of machine vision system 730 and collet style chuck 735 working with cable 100 mounted on pallet 700.
Figure 34:
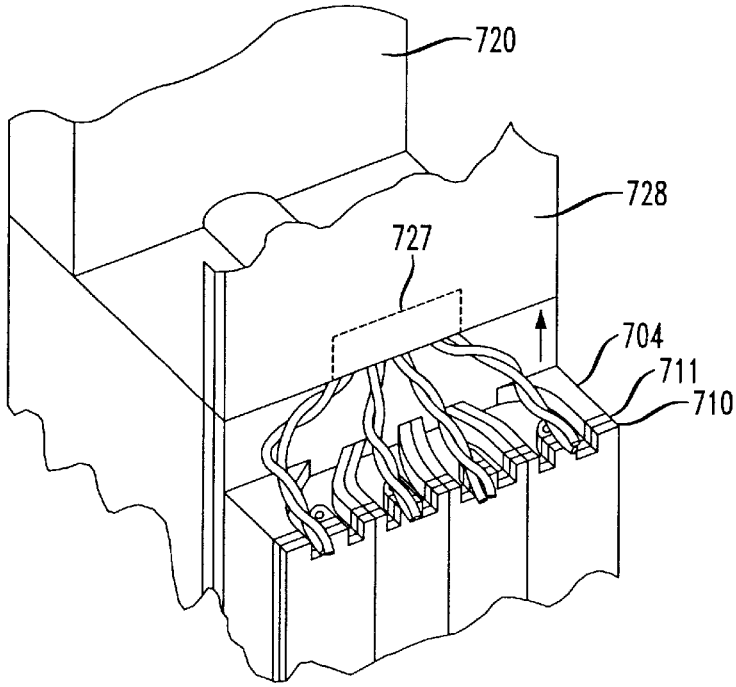
FIG. 34 is a view of blocker 727 of presser 728 pressing twisted wires of cable 100.
Figure 35:
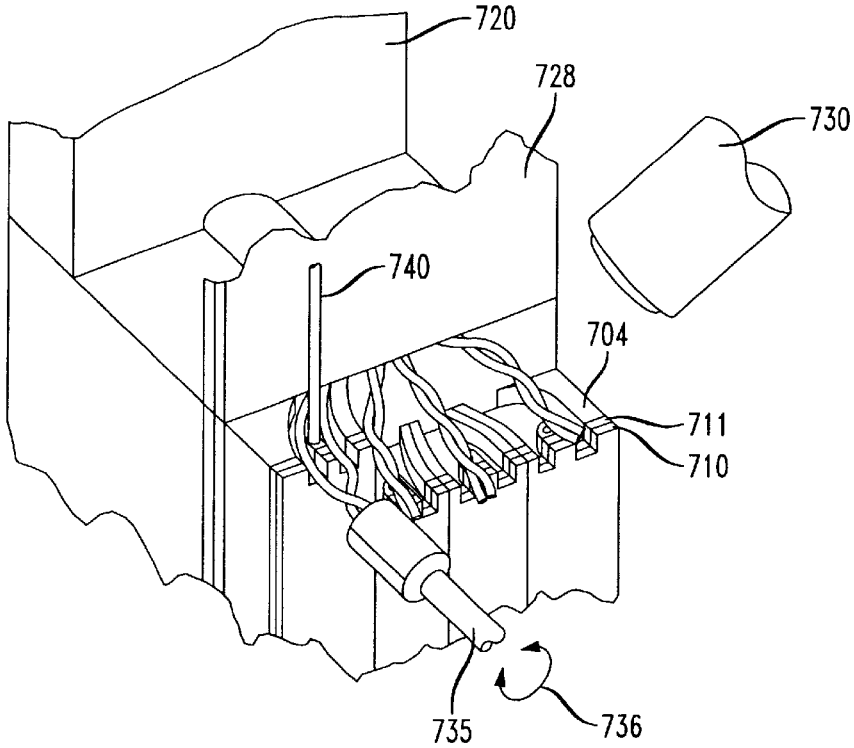
FIG. 35 is a view of machine vision system 730, collet style chuck 735 and pin 740 working on cable 100 mounted on pallet 700.

Pallet 700 is next transferred to station 630, shown in FIGS. 33–35, which includes machine vision system 730 having lens 732, collet style chuck 735 and vertical pin 740. Only the pertinent portion of machine vision system 730 is shown in FIG. 33–35.

At step 820 of FIG. 28, machine vision system 730 at station 630 detects and identifies the color and position of jackets 122, 132, 142, 152, 162, 172, 182, 192 of twisted pairs 120–130, 140–150, 160–170, 180–190 of cable 100 as prepared at step 815. Collet style chuck 735, cooperating with machine vision system 730, holds and relocates each of twisted pairs 120–130, 140–150, 160–170, 180–190 of cable 100 to place a particular pair at a predetermined position, e.g., blue/light blue pair at left.

FIG. 33 shows the detecting and positioning operations of step 820. Collet style chuck 735 grasps one of twisted pairs 120–130, 140–150, 160–170, 180–190 and relocates the selected twisted pair to be in a predetermined color sequence according to information from machine vision system 730. Collet style chuck 735 can move freely along the directions indicated by arrow 736. Machine vision system 730 identifies the colors of twisted pairs 120–130, 140–150, 160–170, 180–190 and gives collet style chuck 735 information regarding the predetermined color sequence of the twisted pairs. A suitable system for use as machine vision system 730 is a Cognex System from Cognex Corporation in Natick, Mass. Alternatively, the F-30 system available from Omron Electronics, Schaumburg, Ill. may be used.

At step 825 of FIG. 28, the sequenced twisted wire pairs are clamped on pallet 700 to avoid further unintended relocation.

FIG. 34 shows the clamping operation of step 825. After relocation of twisted pairs 120–130, 140–150, 160–170, 180–190 by collet style chuck 735, space 729 of presser 728 is blocked by blocker 727 to clamp the sequence of the twisted pairs, thereby prohibiting the twisted pairs from further movement. At the conclusion of step 825, twisted pairs 120–130, 140–150, 160–170, 180–190 are located in a predetermined color sequence and in grooves 950*a*–950*d* shown in FIG. 29.

At step 830 of FIG. 28, movable body 704 is lifted up to align with the surface of main body 702. FIG. 35 shows the sequencing operation of step 830. Machine vision system 730 identifies each of twisted pairs 120–130, 140–150, 160–170, 180–190 of cable 100 and collet style chuck 735 twists/untwists each of the twisted pairs to be in a predetermined color sequence of wires 120, 130, 140, 150, 160, 170, 180, 190. Vertical pin 740 is inserted to establish a predetermined space between the wires of the twisted pairs while collet style chuck 735 holds the twisted pairs. At the conclusion of step 830, wires 120, 130, 140, 150, 160, 170, 180, 190 of cable 100 are in grooves 708*a*–708*h* of pallet 700 in a predetermined color sequence.

Figure 36:
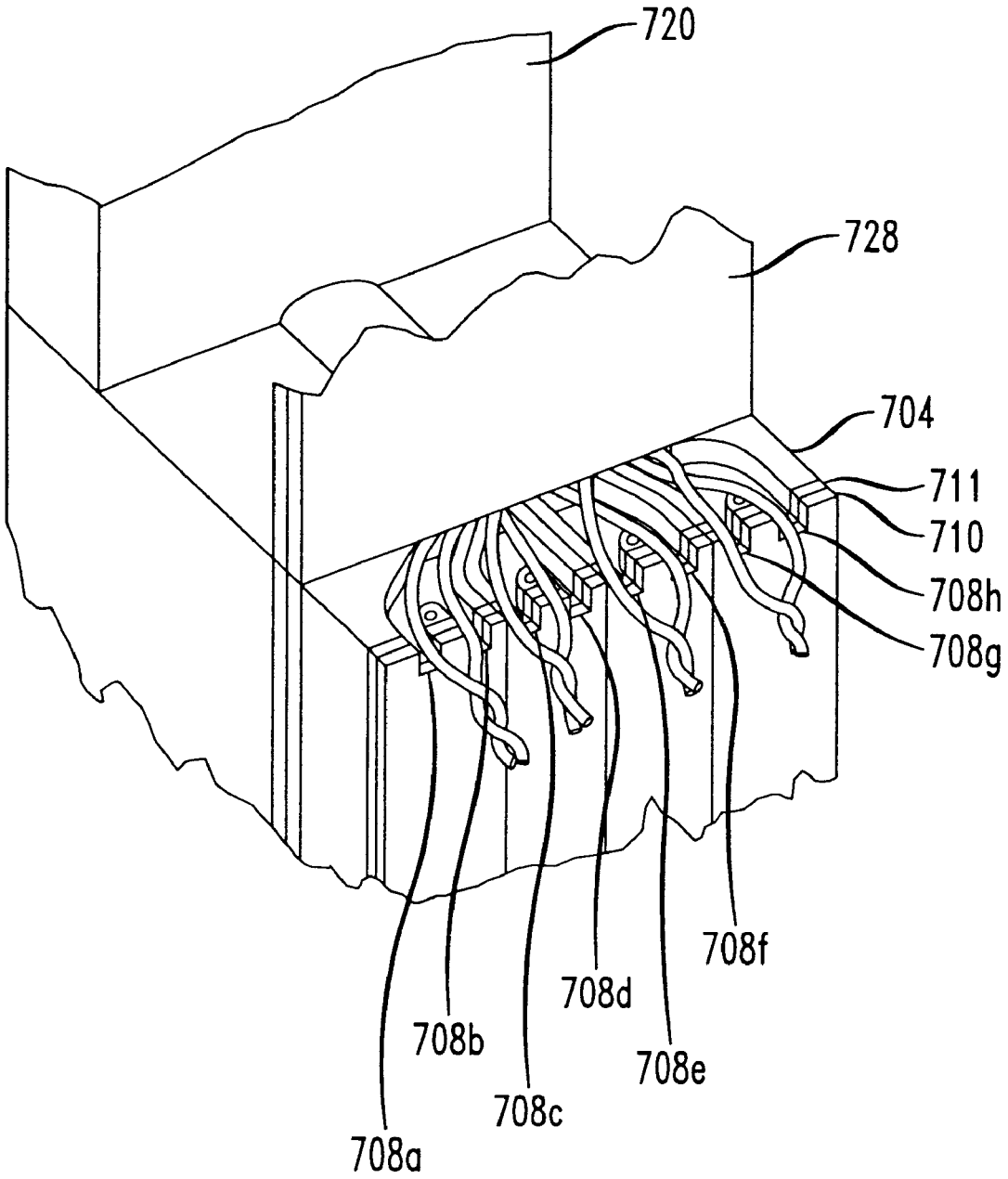
FIG. 36 is a view of the sequenced wire pairs of cable 100 on pallet 700.

FIG. 36 shows wires 120, 130, 140, 150, 160, 170, 180, 190 of cable 100 sequenced and placed in grooves 708*a*–708*h* of pallet 700. The ends of the twisted pairs remain twisted.

Figure 37A:
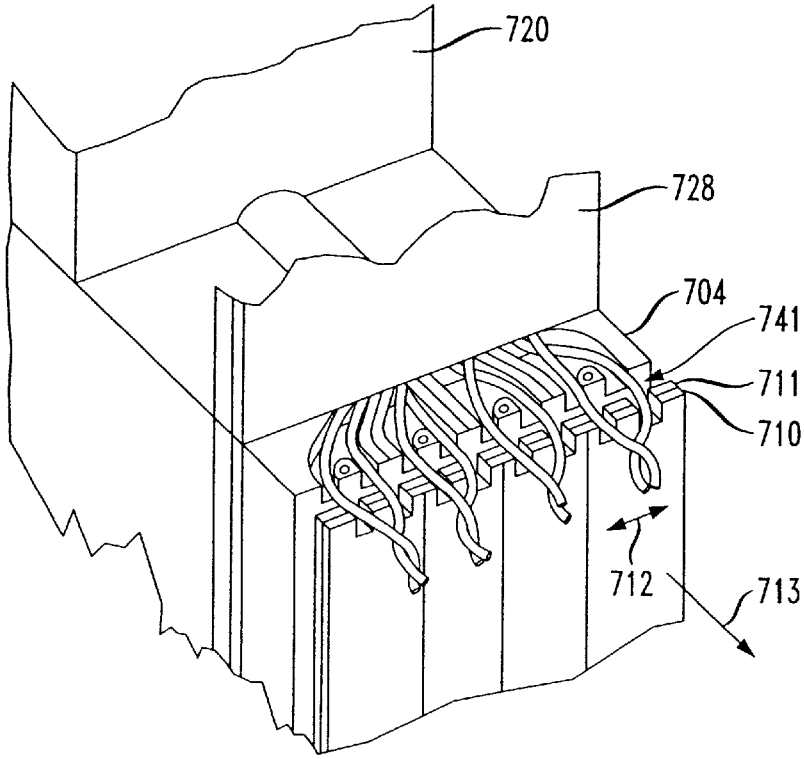
FIG. 37A illustrates movable surfaces 710, 711 being detached from movable body 704 of pallet 700.
Figure 37B:
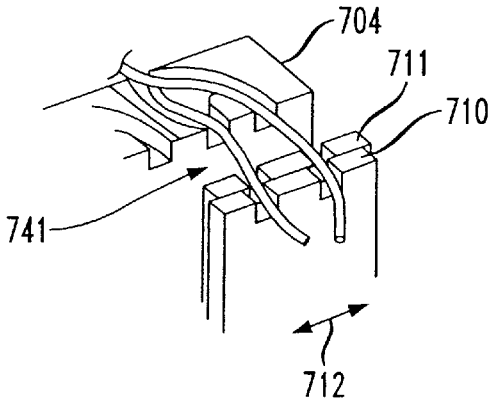
FIG. 37B is a magnified view of movable surfaces 710, 711 of pallet 700.

As shown in FIGS. 37A and 37B, after the wires are placed in grooves 708*a*–708*h* in the predetermined color sequence, movable surfaces 710, 711 are detached from the side of movable body 704 in the direction indicated by arrow 713. Detaching movable surfaces 710, 711 creates gap 741 between movable body 704 and movable surfaces 710, 711. As shown in FIG. 37B, each of movable surfaces 710, 711 slides in opposite directions indicated by arrow 712 to secure wires 120, 130, 140, 150, 160, 170, 180, 190. Clamp 720 and presser 728 are then released.

Figure 38:
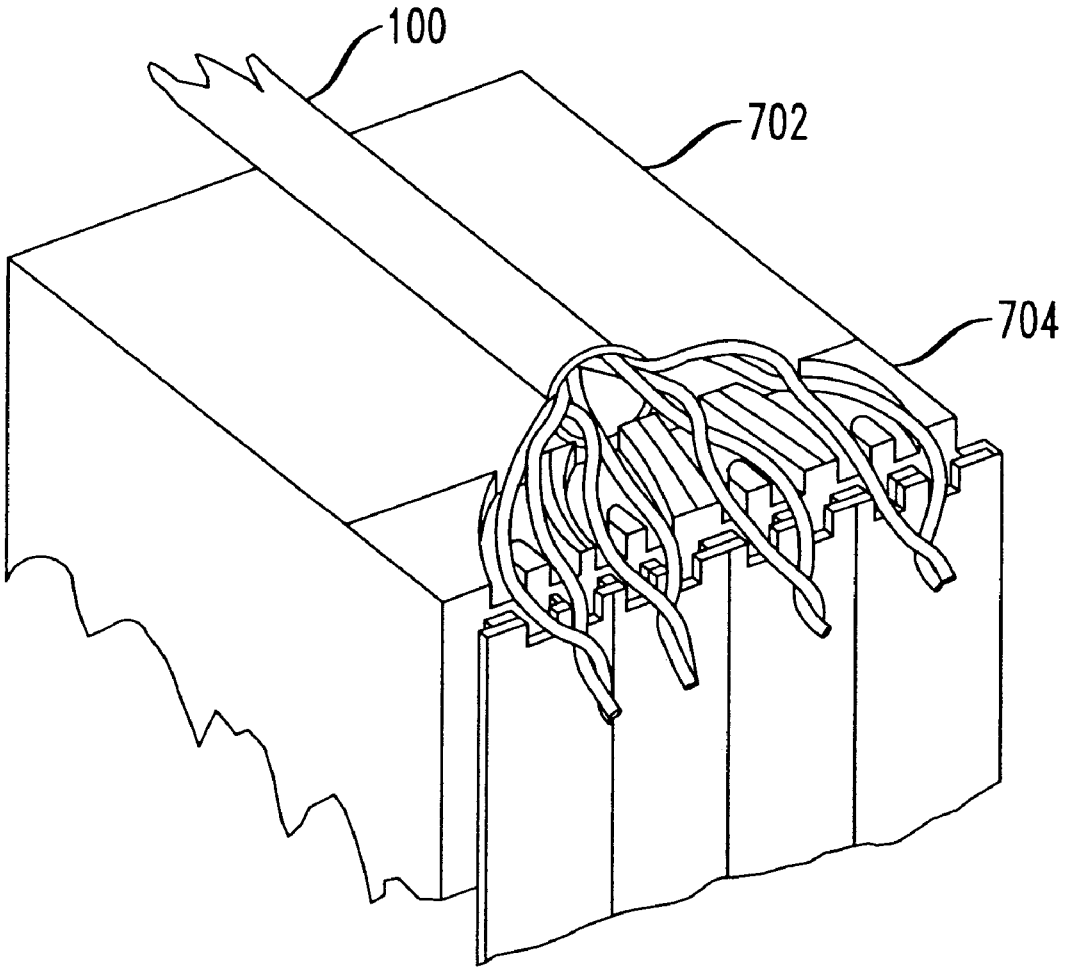
FIG. 38 is a view of sequenced wires of cable 100 on pallet 700.

FIG. 38 shows the sequenced wires on pallet 700 after the sequencing process described above.

Pallet 700 is next transferred to station 640 which includes manipulators 750, 760, a feeder (not shown) and a cutter (not shown). The feeder may be a bowl, tape or flexible feeder. Manipulator 750 serves to transfer parts from the feeder.

At step 835 of FIG. 28, first housing member 202 of two piece type connector 200 is assembled with wires 120, 130, 140, 150, 160, 170, 180, 190 of cable 100 at station 640.

Figure 39:
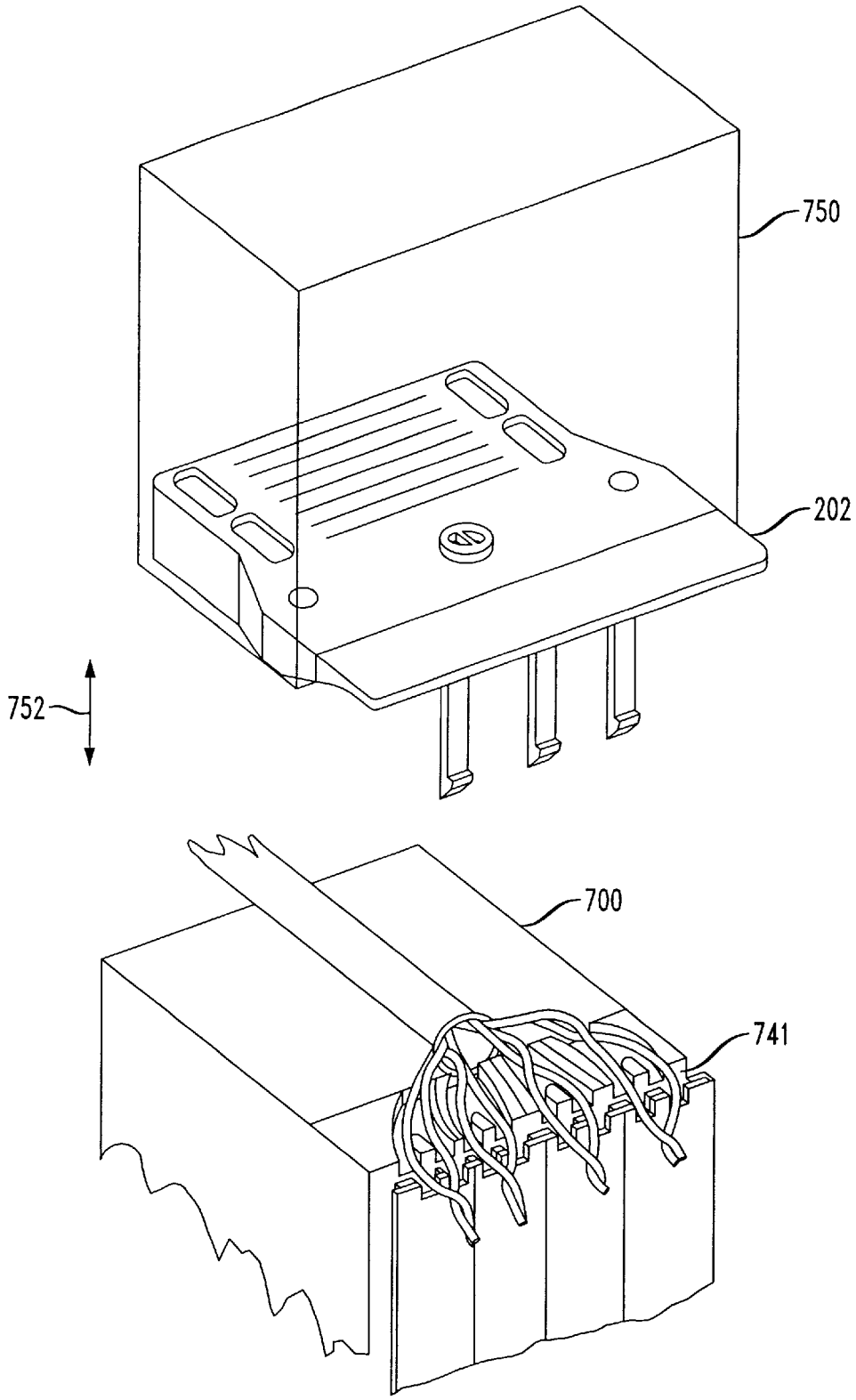
FIG. 39 is a view of first feeder 750 holding first housing member 202 of two piece type 110 connector 200 placed on top of the sequenced wires as in FIG. 38.

FIG. 39 shows manipulator 750 loaded with first housing member 202, and pallet 700 loaded with sequenced wires 120, 130, 140, 150, 160, 170, 180, 190 of cable 100. Manipulator 750 is aligned so that gaps 220*a*–220*h* of first housing member 202 are positioned on top of gap 741 of pallet 700. Manipulator 750 then moves down to the top of pallet 700 along the direction indicated by arrow 752.

Figure 40:
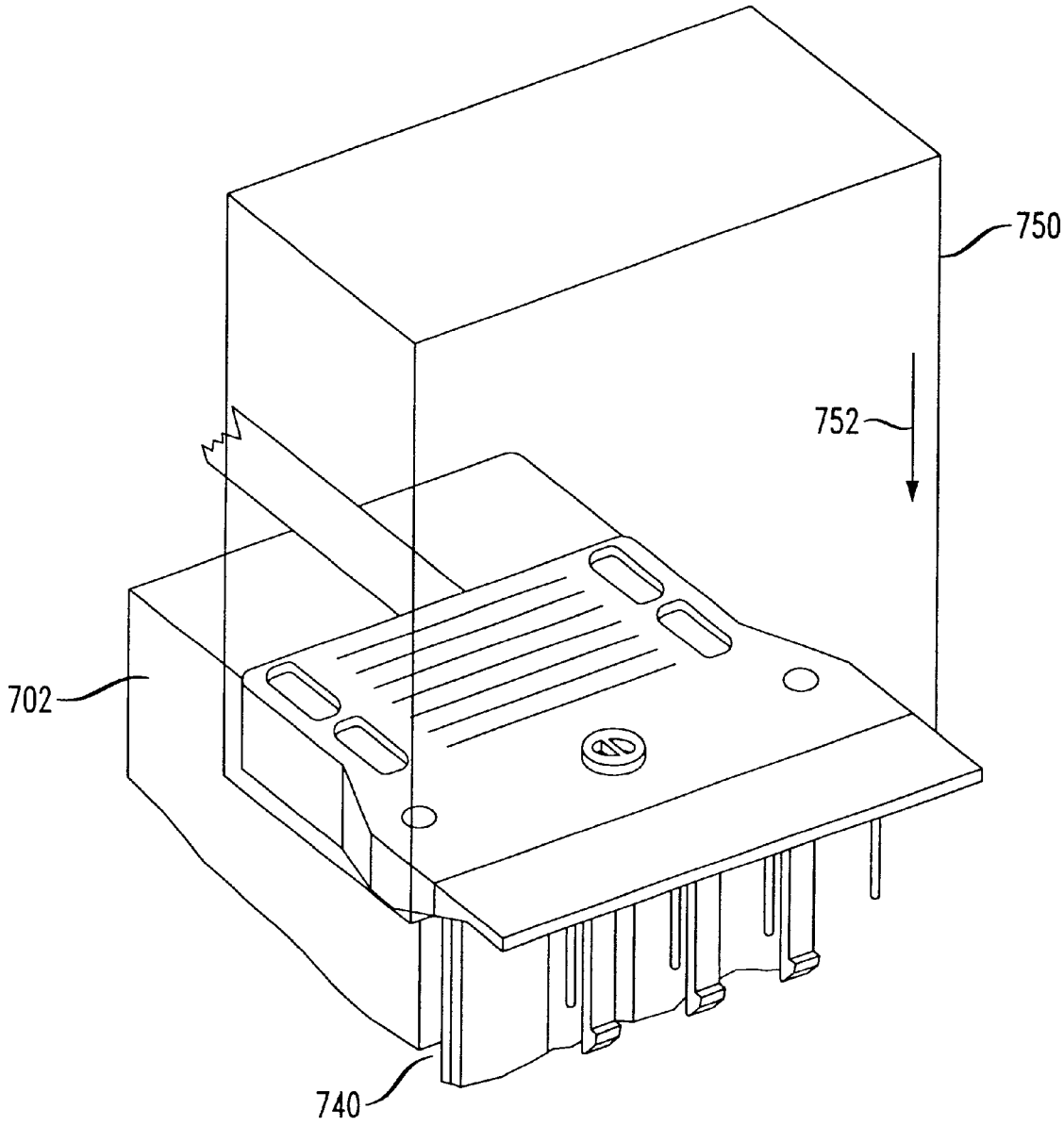
FIG. 40 is a view of first feeder 750 mated to pallet 700 loaded with the sequenced wires of cable 100.

FIG. 40 shows manipulator 750 holding first housing member 202 of two piece type connector 200 mated to pallet 700 holding sequenced wires 120, 130, 140, 150, 160, 170, 180, 190 of cable 100. First housing member 202 is seen to be within manipulator 750. Manipulator 750 presses member 202 with a predetermined force to insert each of the sequenced wires of cable 100 into gaps 220*a*–220*h* and IDC grooves 217*a*–217*h* of first housing member 200. A cutter (not shown) is then introduced through the bottom of gap 741 of pallet 700. The cutter cuts the portions of the sequenced wires which extend beyond IDC grooves 217*a*–217*h* of first housing member 200. Manipulator 750 is then lifted from main body 702 of pallet 700 while holding first housing member 202 assembled with the wires of cable 100.

At step 840 of FIG. 28, manipulator 760 feeds second housing member 204, and at station 640, second housing member 202 is assembled with first housing member 202.

Figure 1:
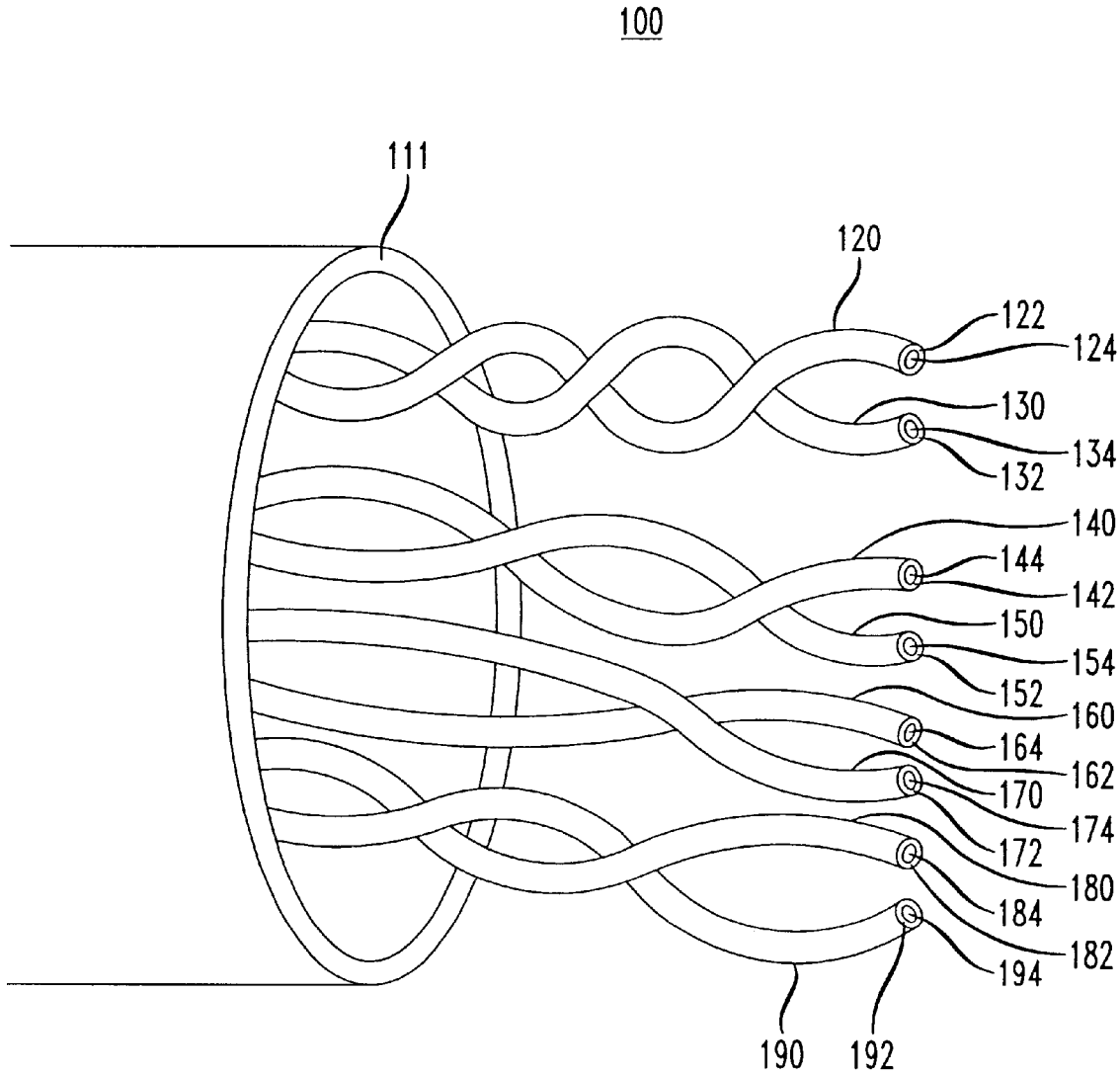
FIG. 1 is a view of cable 100 having four twisted wire pairs.
Figure 2:
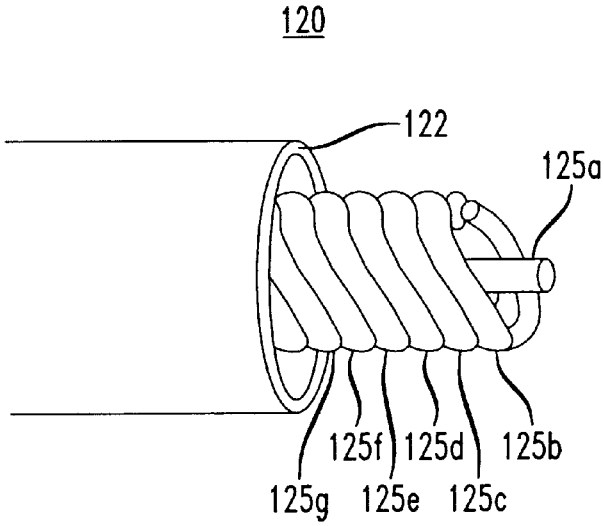
FIG. 2 is an enlarged view of wire 120 in FIG. 1.
Figure 3:
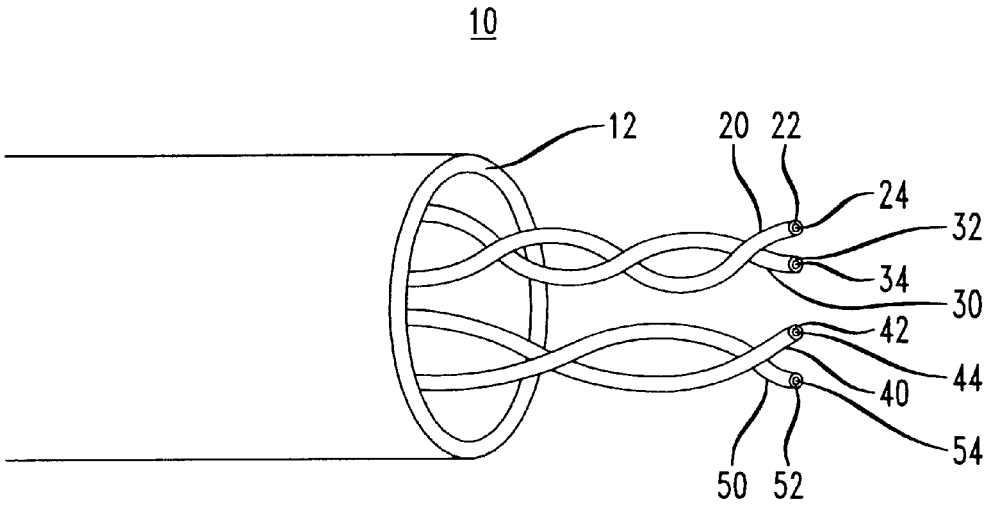
FIG. 3 is a view of cable 10 having two pairs of twisted wires.
Figure 4:
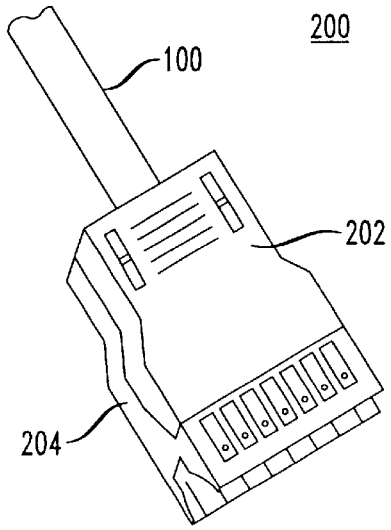
FIG. 4 is a view of an assembled two piece type 110 connector 200 with cable 100.
Figure 5:
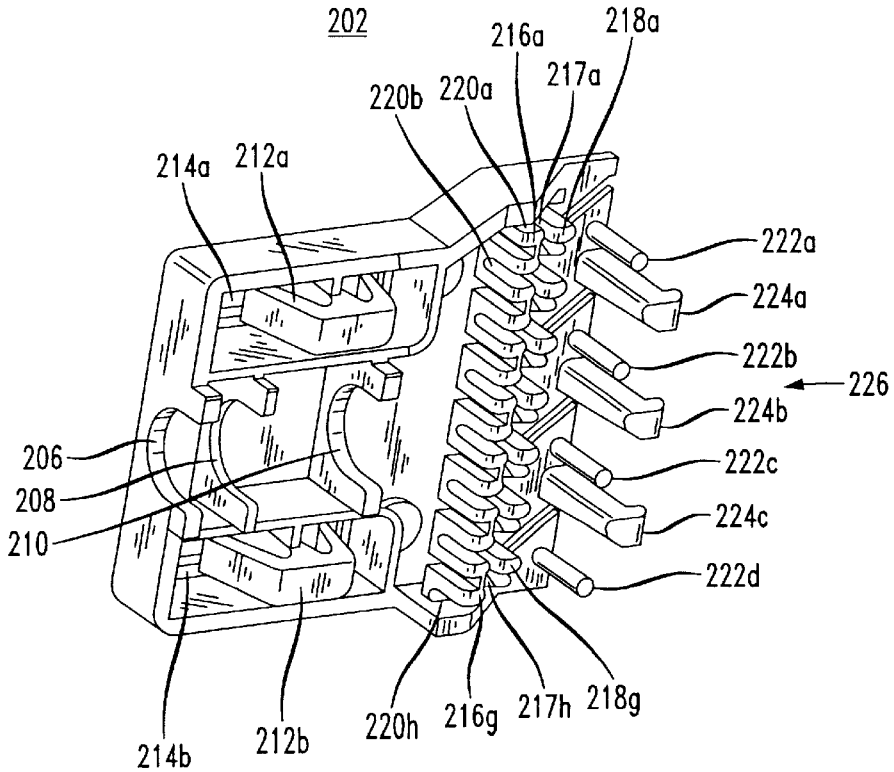
FIG. 5 illustrates first housing member 202 of two piece type 110 connector 200.
Figure 6:
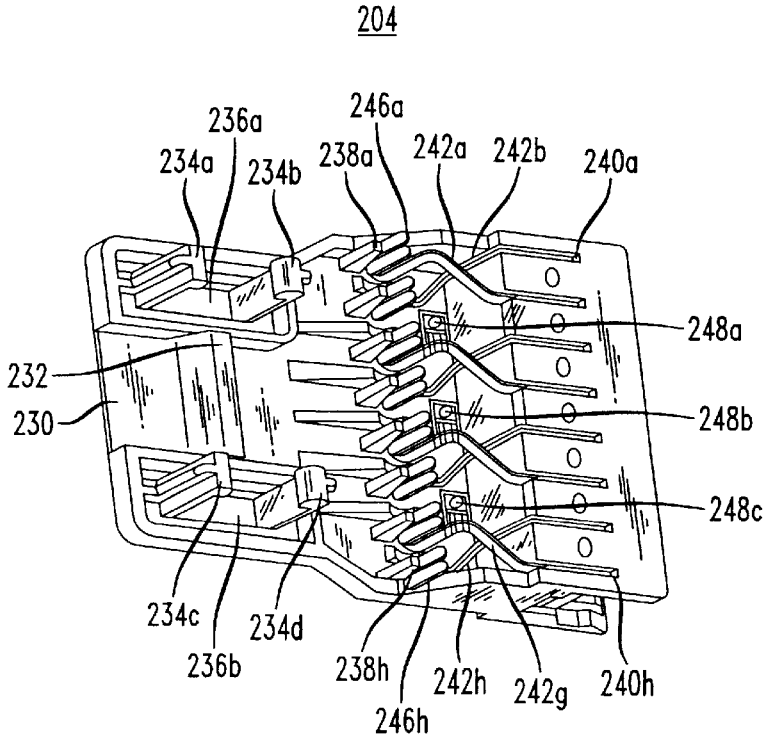
FIG. 6 illustrates second housing member 204 of two piece type 110 connector 200.
Figure 7:
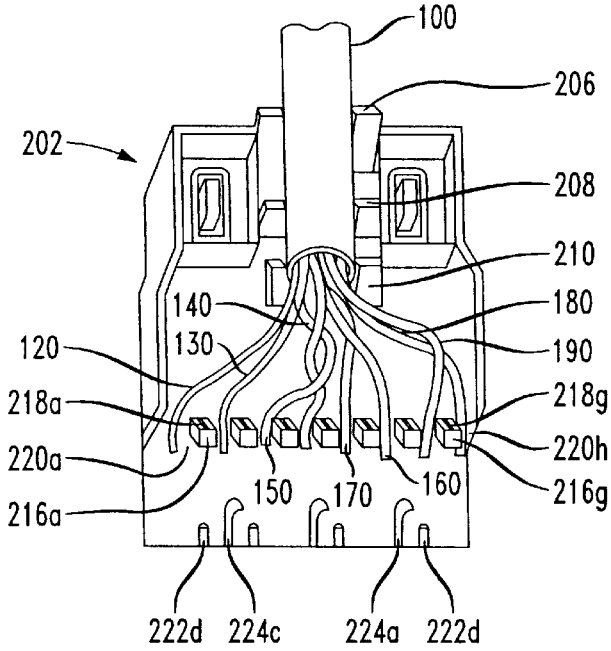
FIG. 7 a view of first housing member 202 assembled with cable 100.
Figure 8F:
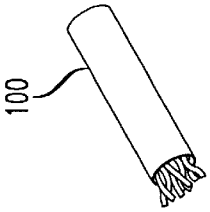
FIGS. 8A–8F depict the components of four piece type 110 connector 300.
Figure 8D:
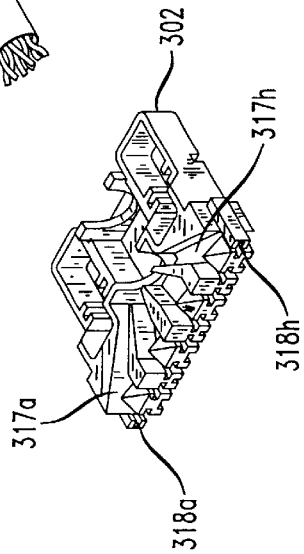
Figure 8E:
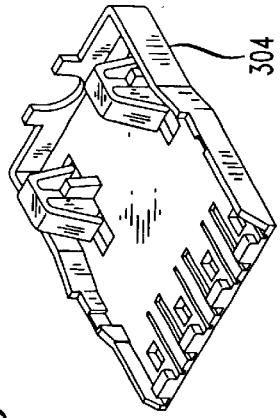
Figure 8C:
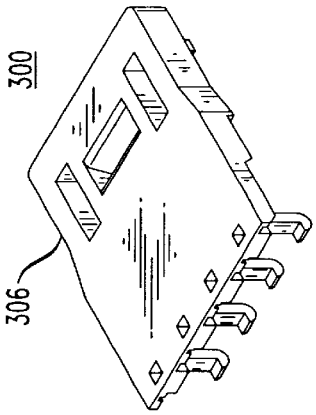
Figure 8B:
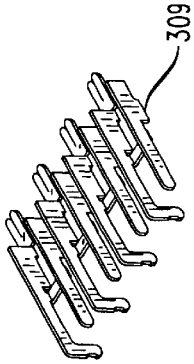
Figure 8A:
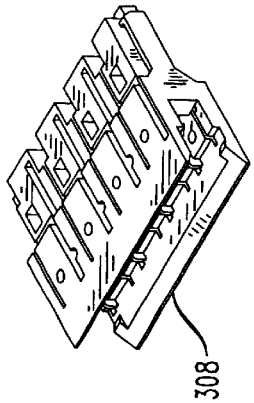
Figure 9:
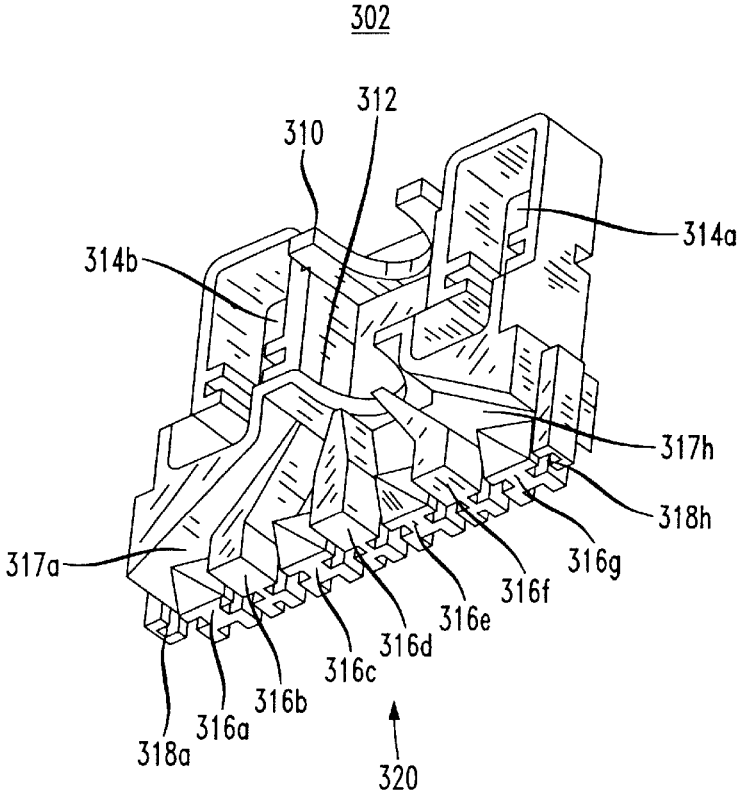
FIG. 9 illustrates base member 302 of four piece type 110 connector 300.
Figure 10:
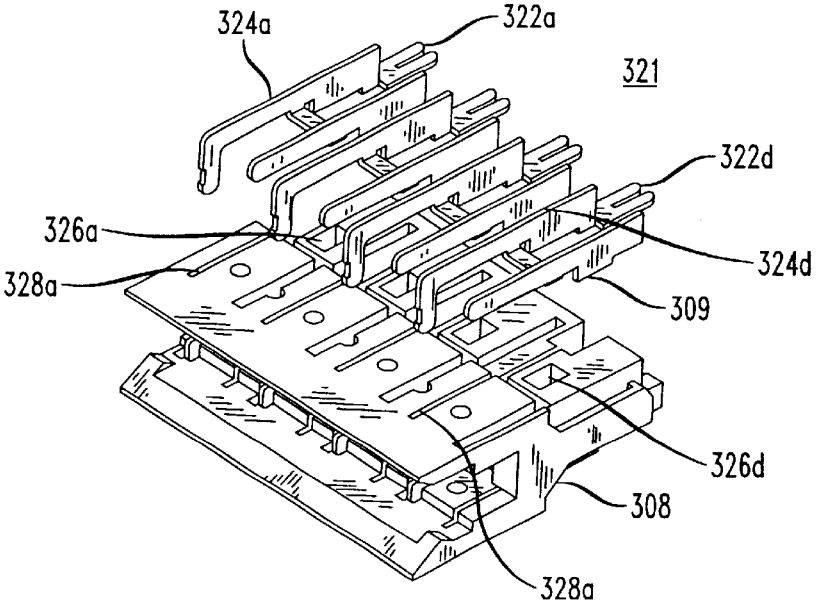
FIG. 10 illustrates contact base 308 and four top contact 309 four piece type 110 connector 300 before assembly.
Figure 11:
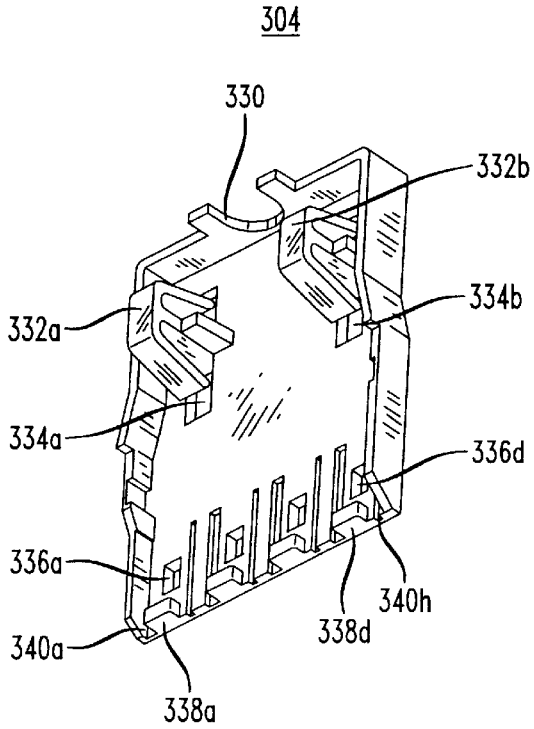
FIG. 11 illustrates first housing member 304 of four piece type 110 connector 300.
Figure 12:
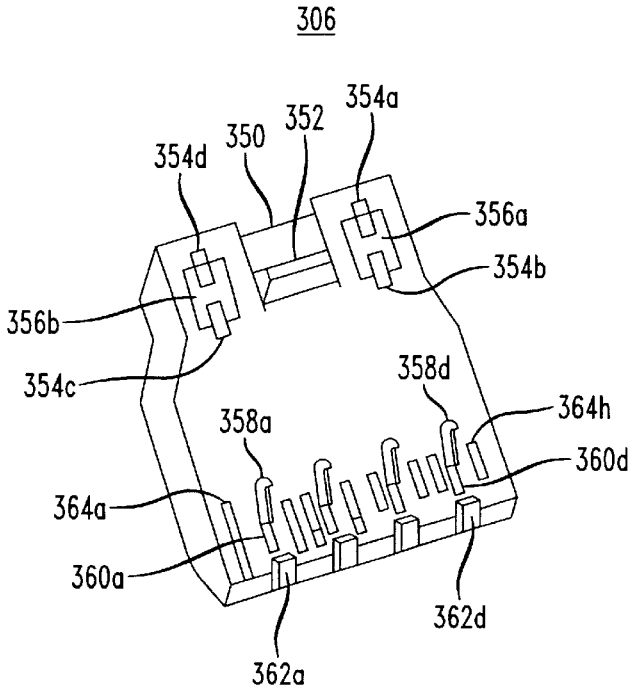
FIG. 12 illustrates second housing member 306 of four piece type 110 connector 300.
Figure 13:
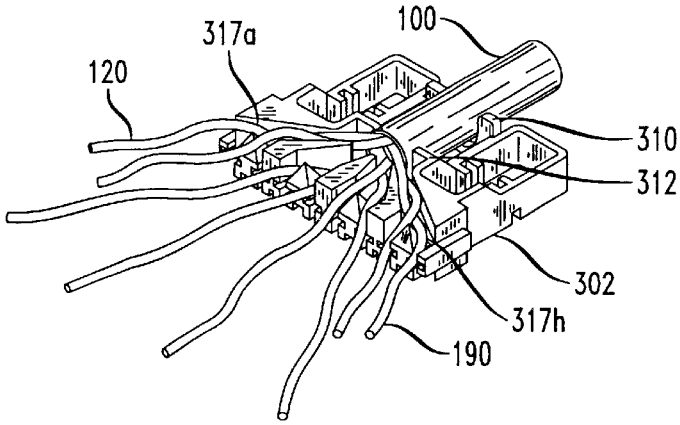
FIG. 13 is a view of base member 302 assembled with cable 100.
Figure 14:
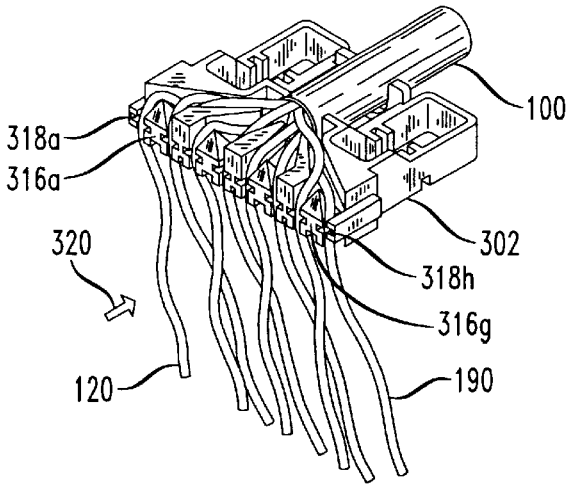
FIG. 14 is a view of the sub-assembly of FIG. 13 after the wires of cable 100 are inserted into IDC grooves of base member 302.
Figure 15:
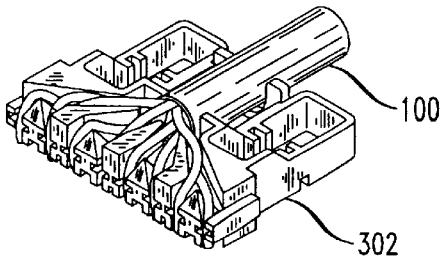
FIG. 15 is a view of the sub-assembly of FIG. 14 after the end of the wires of cable 100 have been trimmed.
Figure 16B:
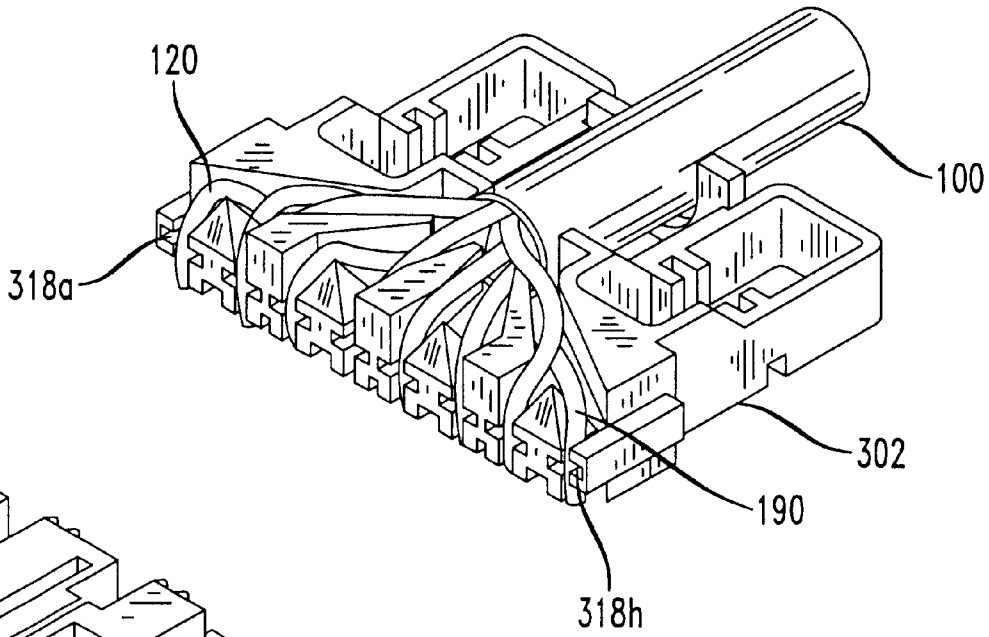
FIG. 16B is a view of the sub-assembly of FIG. 15.
Figure 16A:
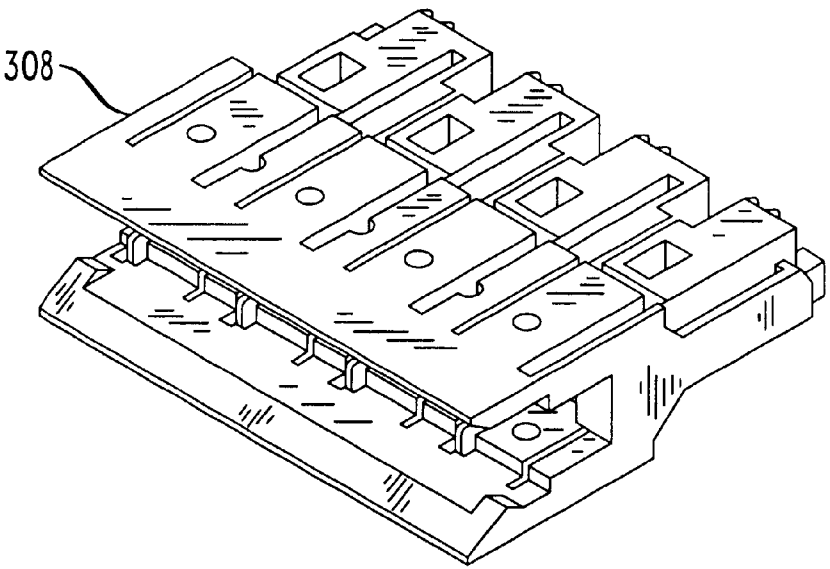
FIG. 16A is a view of contact base 308 assembled with contact 309.
Figure 17:
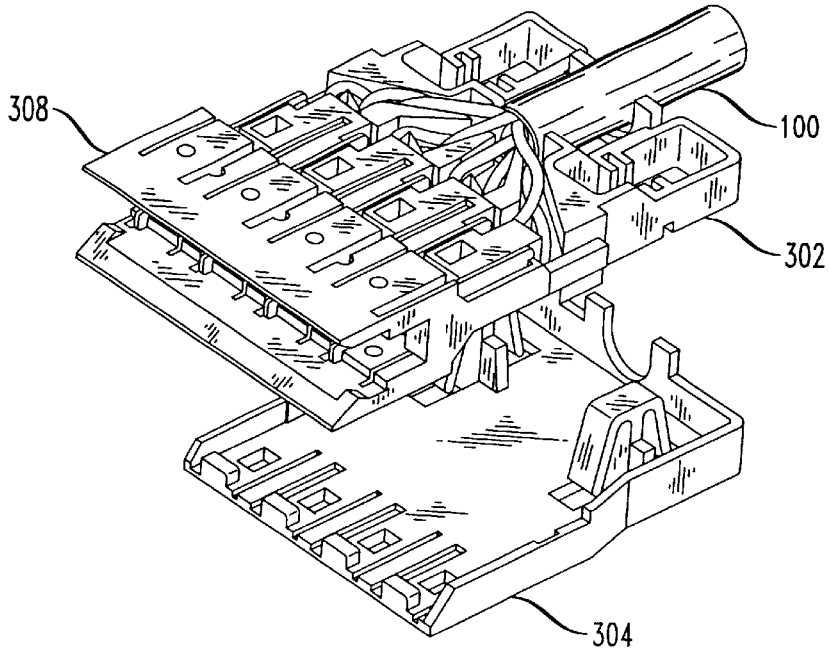
FIG. 17 illustrates the sub-assembly of FIG. 16 being assembled with first housing member 202.
Figure 18:
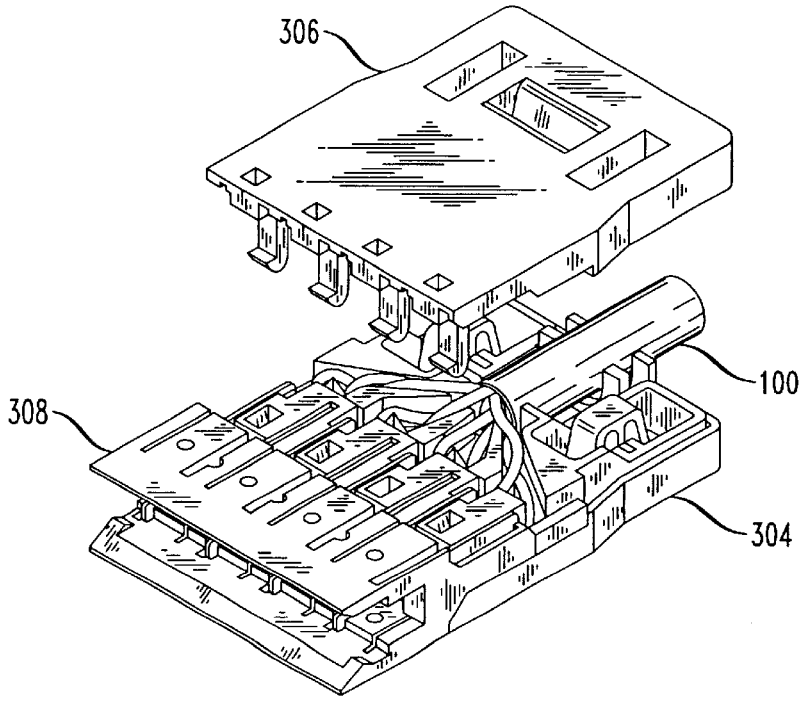
FIG. 18 illustrates the sub-assembly of FIG. 17 being assembled with second housing member 204.
Figure 19:
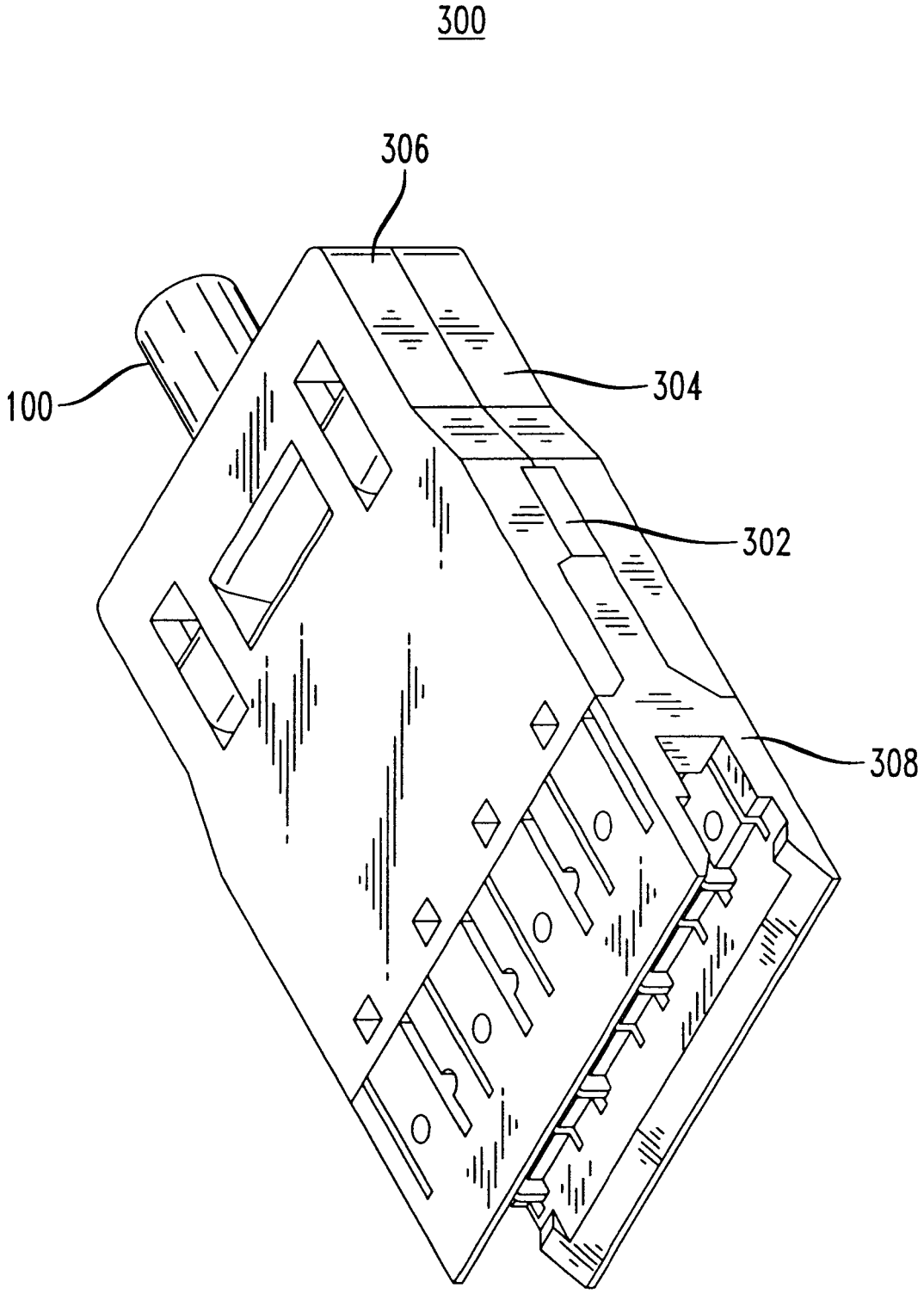
FIG. 19 is a view of completed assembly of four piece type 110 connector 300.
Figure 20:
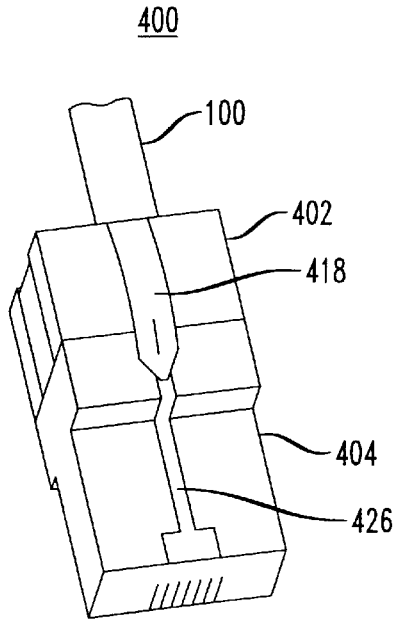
FIG. 20 is a view of assembled D8GS connector 400.
Figure 21:
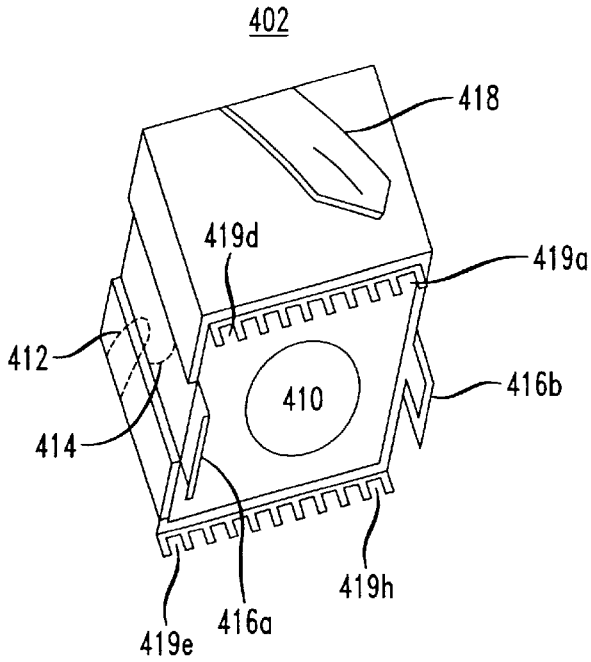
FIG. 21 is a view of first housing member 402 of D8GS connector 400.
Figure 22:
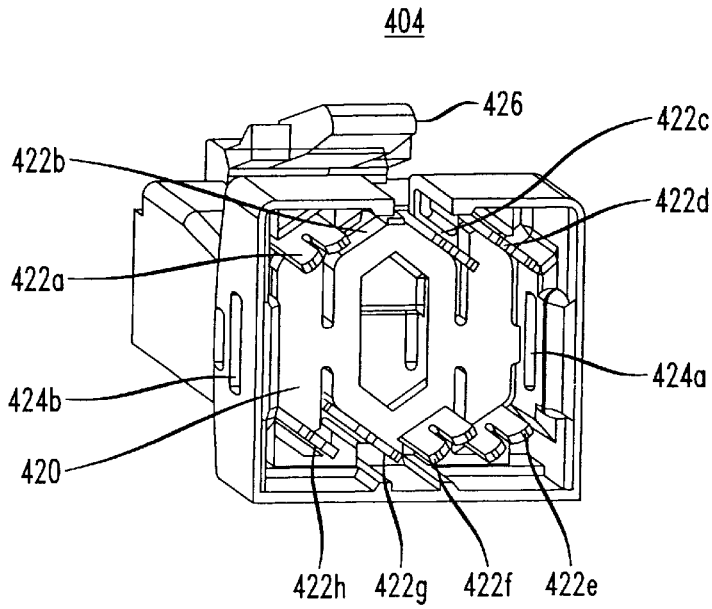
FIG. 22 is a view of second housing member 404 of D8GS connector 400.
Figure 23:
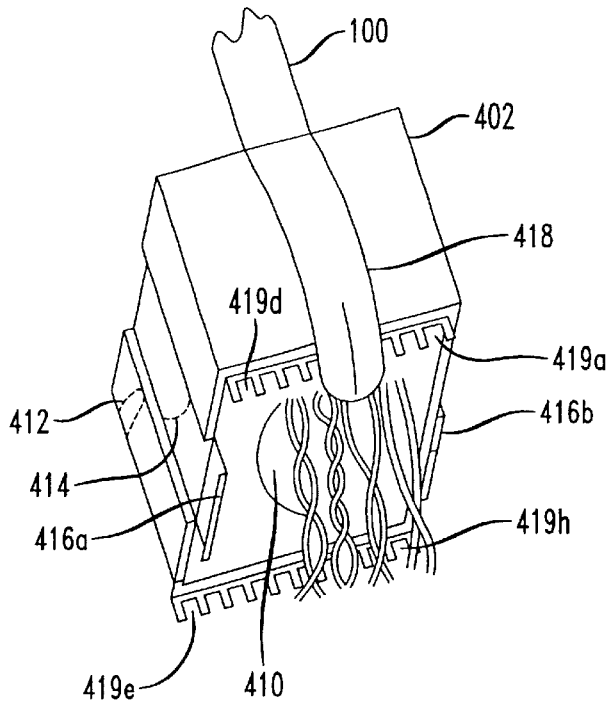
FIG. 23 is a view of first housing member 402 assembled with cable 100.
Figure 41:
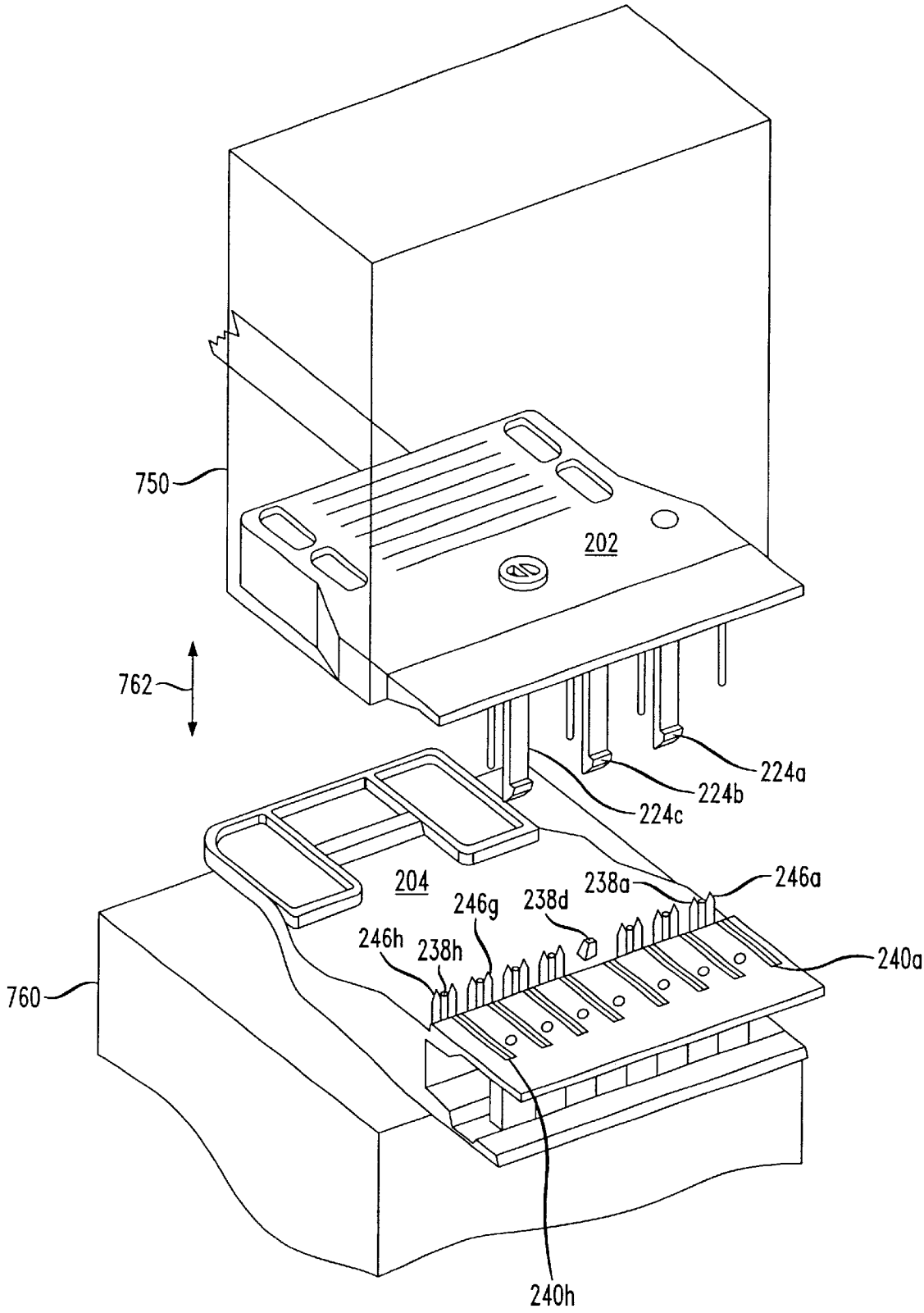
FIG. 41 is a view of second feeder 760 holding second housing member 204 placed on the bottom of first feeder 750 as in FIG. 40.

FIG. 41 shows manipulator 760 loaded with second housing member 204 of two piece type connector 200. Second housing member 204 is also shown in FIG. 6. In FIG. 41, IDC 246*d* is not shown so that upstanding post 238d can be clearly shown. Manipulator 760 is positioned beneath manipulator 750. Manipulators 750, 760 are aligned so that each of IDCs 246*a*–246*h* of second housing member 204 matches with IDC grooves 217*a*–217*h* of first housing member 202, respectively.

Manipulator 750 moves down to the top of manipulator 760 along the direction indicated by arrow 762. Manipulator 750 presses member 202 with a predetermined force to assure that each of IDCs 246*a*–246*h* is inserted into IDC grooves 217*a*–217*h* of first housing member 200 until the wires of cable 100 respectively rest on the tops of upstanding posts 238*a*–238*h*, completing the automatic assembly of two piece type connector 200.

Assembled two piece type connector 200 is now ready to be transferred to station 650, where the assembled connector 200 is tested and packed for shipping.

Station 650 includes testing equipment (not shown). After testing, and if results are good, the assembled cords are packed for shipment. Station 650 also has equipment for rejecting assembled connectors having inadequate test results. The rejected cables having connectors may be sent back to the appropriate station to correct defects, may be discarded, or may be sold as lower performance level merchandise.

Station 660 includes a central control station (not shown) for automatically controlling the activity of stations 610–660. Alternatively, each of stations 610, 620, 630, 640, 650 has its own independent control system.

Figure 42:
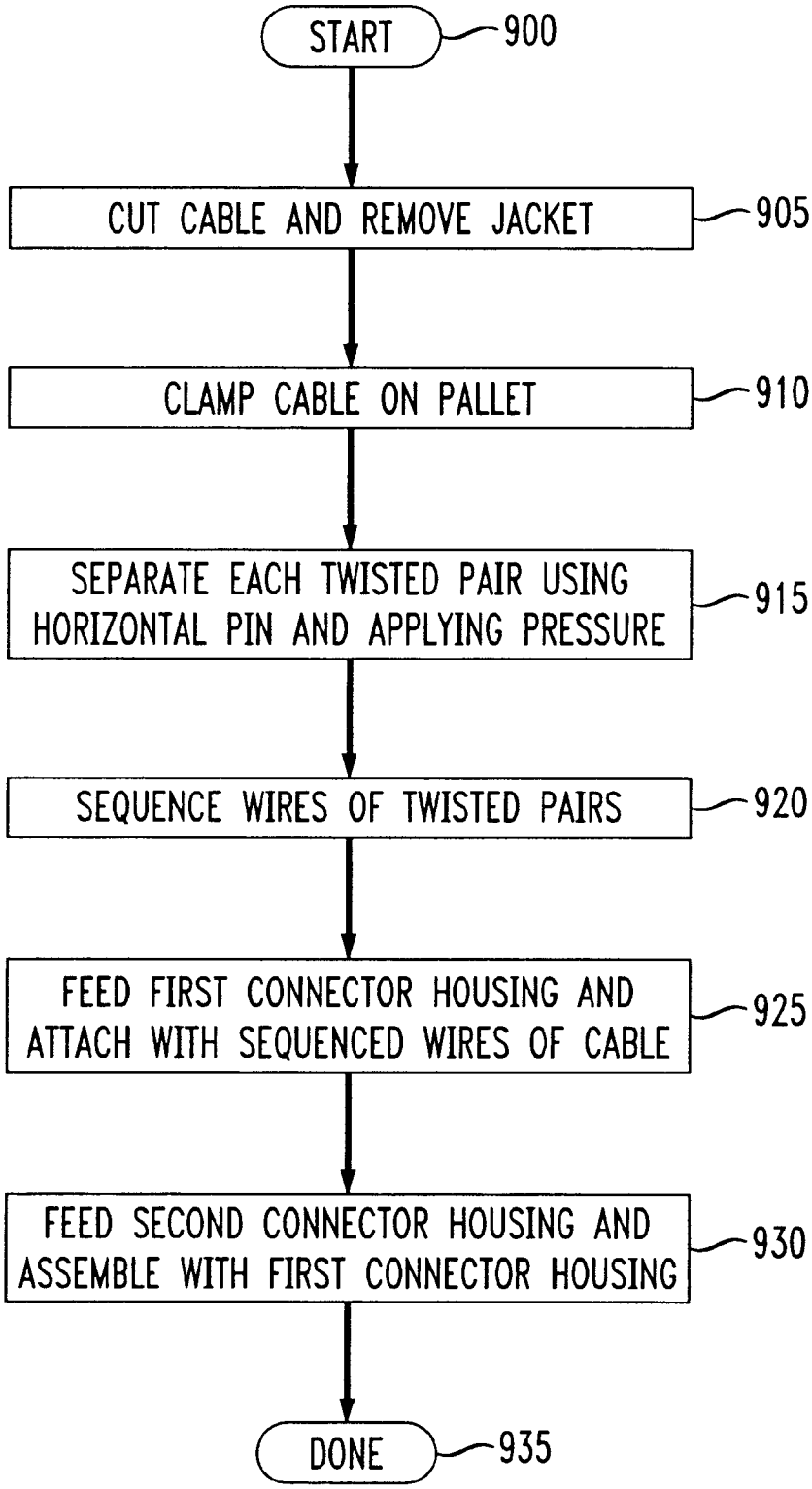
FIG. 42 is a flow chart of an automatic assembly procedure of two piece type 110 connector 200 for another embodiment.

With the present automated assembly technique, most of the subsystems are identical for assembly of 110 connectors, D8GS connectors, RJ45 connectors and RJ11 connectors. Generally, the type of the connectors determines the variation in the production lines. Tooling changes in the wire and manipulator housings are needed for different types of connectors or newly designed connector assemblies FIG. 42 shows a flow chart of an assembly procedure for another embodiment. Steps 805, 810, 815 in FIG. 28 correspond to steps 905, 910, 915 in FIG. 42. In FIG. 42, positioning twisted wire pair step 820, clamping the positioned twisted pairs step 825, and positioning wires step 830 of FIG. 28 are combined together as sequencing step 920.

At step 920 of FIG. 42, pin 722 shown in FIG. 31 is inserted horizontally into twisted wire pairs 120–130, 140–150, 160–170, 180–190 to fan out the wire pairs and presser 728 presses the separated twisted wire pairs against the surface of pallet 700. Instead of sequencing each twisted pairs first as in the process of FIG. 28, machine vision system 730 identifies each of wires 120, 130, 140, 150, 160, 170, 180, 190 of cable 100. Collet style chuck 735 grasps each of the wires and relocates the selected wire to a predetermined position. The sequenced wires are clamped on the carrier to avoid further unintended relocation.

In one embodiment, machines are operated by centralized computer control. In another embodiment, individual machine control programs are generated in each machine and each machine is operated independently. This method of operation is particularly useful where assembly lines or portions of assembly lines are comprised of machines placed side by side in a row. The assembling process takes place by transporting a carrier from machine to machine.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A method of automatically assembling a cable having at least two twisted wire pairs surrounded by a common insulating jacket, each wire of the twisted wire pairs having a jacket with a respectively different color, comprising the steps of;

(a) removing a section of the common insulating jacket to expose the ends of the at least two twisted wire pairs;

(b) automatically inserting a pin into the exposed ends of the at least two twisted wire pairs and rotating the pin to separate the twisted wire pairs;

(c) automatically detecting the colors of the jackets of the twisted wire pairs; and (d) automatically positioning the wires of the twisted wire pairs in a predetermined sequence based on the colors of the jackets.

2. The method of claim 1, further comprising mounting the cable on a pallet for transporting the cable between stations of an automatic assembly line.

3. The method of claim 2, wherein the pallet has a movable part and further comprising manipulating the twisted wire pairs using the movable part.

4. The method of claim 3, wherein the movable part has a plurality of grooves and further comprising placing the twisted wire pairs in the plurality of grooves.

5. The method of claim 3, wherein the movable part has a plurality of movable surfaces and further comprising moving the plurality of movable surfaces to inhibit movement of the wires.

6. The method of claim 3, further comprising adjusting the height of the movable part for improving ease of access to the twisted wire pairs.

7. The method of claim 1, wherein the automatically detecting is performed by a machine vision system.

8. The method of claim 7, further comprising;

automatically applying pressure to the twisted wire pairs so that the twisted wire pairs fan out relative to each other.

9. The method of claim 1, further comprising automatically manipulating each of the twisted wire pairs so that the wires of the twisted pairs can be separately positioned.

10. The method of claim 1, further comprising automatically using pins to establish spacing between the wires of the twisted pairs.

11. The method of claim 1, further comprising automatically attaching a connector to the automatically positioned twisted wire pairs.

12. The method of claim 11, wherein the connector is one of a 110 connector, a D8GS connector, an RJ45 connector and an RJ11 connector.

13. The method of claim 11, further comprising automatically trimming ends of the twisted wire pairs located inside the connector.

14. The method of claim 11, wherein the automatically attaching includes automatically fitting a first housing to the automatically positioned twisted wire pairs.

15. The method of claim 11, wherein the automatically attaching includes automatically assembling connector housings.

16. The method of claim 15, wherein the automatically assembling includes automatically pressing the connector housings together.

* * * * *